US010353339B2

(12) United States Patent
Koishi et al.

(10) Patent No.: US 10,353,339 B2
(45) Date of Patent: Jul. 16, 2019

(54) CARTRIDGE WITH RESTRICTION MEMBER FOR RESTRICTING RELATIVE MOVEMENT OF TONER CARTRIDGE AND PROCESS CARTRIDGE

(71) Applicant: CANON KABUSHIKI KAISHA, Tokyo (JP)

(72) Inventors: Isao Koishi, Yokohama (JP); Shinjiro Toba, Yokohama (JP); Masaaki Sato, Yokohama (JP); Hiroshi Takarada, Kawasaki (JP); Keita Moue, Kawasaki (JP); Toshiyuki Karakama, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/903,495

(22) Filed: Feb. 23, 2018

(65) Prior Publication Data

US 2018/0253057 A1 Sep. 6, 2018

(30) Foreign Application Priority Data

Mar. 3, 2017 (JP) ..... 2017-040723

(51) Int. Cl.
*G03G 15/08* (2006.01)
*G03G 21/18* (2006.01)

(52) U.S. Cl.
CPC ..... *G03G 21/1814* (2013.01); *G03G 15/0855* (2013.01); *G03G 15/0865* (2013.01); *G03G 21/1821* (2013.01); *G03G 2221/1654* (2013.01)

(58) Field of Classification Search
None
See application file for complete search history.

(56) References Cited

U.S. PATENT DOCUMENTS

| | | | |
|---|---|---|---|
| 5,208,634 | A | 5/1993 | Ikdemoto et al. |
| 5,294,960 | A | 3/1994 | Nomura et al. |
| 5,331,373 | A | 7/1994 | Nomura et al. |

(Continued)

FOREIGN PATENT DOCUMENTS

| | | | |
|---|---|---|---|
| EP | 2 610 684 | A2 | 12/2012 |
| JP | H06-258941 | A | 9/1994 |
| JP | 3086763 | B2 | 9/2000 |

OTHER PUBLICATIONS

Extended Search Report in European Patent Application No. 18 159 429.2, dated Jul. 27, 2018.

*Primary Examiner* — Victor Verbitsky
(74) *Attorney, Agent, or Firm* — Venable LLP

(57) ABSTRACT

A cartridge detachably attached to an apparatus body of an image forming apparatus includes: a restriction member provided on a toner cartridge, the restriction member being movable between a restriction position, at which relative movement between (1) the toner cartridge attached to the attachment portion of the process cartridge and (2) the process cartridge is restricted by an engagement of the restriction member and the process cartridge, and a non-restriction position, at which the relative movement is not restricted; and a driving transmission unit for transmitting a driving force from the apparatus body to the toner cartridge by engaging with the apparatus body. The restriction member moves from the restriction position to the non-restriction position when a driving force reception unit receives the driving force from the driving transmission unit.

16 Claims, 26 Drawing Sheets

(56) References Cited

U.S. PATENT DOCUMENTS 5,452,056 A 9/1995 Nomura et al.
5,455,665 A 10/1995 Baba et al.
5,500,714 A 3/1996 Yashiro et al.
5,508,795 A 4/1996 Kikuchi
5,528,341 A 6/1996 Shishido et al.
5,543,898 A 8/1996 Shishido et al.
5,585,889 A 12/1996 Shishido et al.
5,585,895 A 12/1996 Yashiro et al.
5,617,579 A 4/1997 Yashiro et al.
5,619,309 A 4/1997 Yashiro et al.
5,623,328 A 4/1997 Tsuda et al.
5,638,161 A 6/1997 Numagami et al.
5,682,579 A 10/1997 Nomura et al.
5,689,774 A 11/1997 Shishido et al.
5,749,027 A 5/1998 Ikemoto et al.
5,768,660 A 6/1998 Kurihara et al.
5,774,766 A 6/1998 Karakama et al.
5,794,101 A 8/1998 Watanabe et al.
5,812,909 A 9/1998 Oguma et al.
5,828,928 A 10/1998 Sasago et al.
5,870,654 A 2/1999 Sato et al.
5,878,310 A 3/1999 Noda et al.
5,884,124 A 3/1999 Karakama et al.
5,890,036 A 3/1999 Karakama et al.
5,899,602 A 5/1999 Noda et al.
5,907,749 A 5/1999 Nomura et al.
5,911,096 A 6/1999 Batori et al.
5,920,752 A 7/1999 Karakama et al.
5,940,658 A 8/1999 Yokoi et al.
5,943,528 A 8/1999 Akutsu et al.
5,953,560 A 9/1999 Numagami et al.
5,966,566 A 10/1999 Odagawa et al.
5,974,288 A 10/1999 Sato
5,987,278 A 11/1999 Nomura et al.
6,032,007 A 2/2000 Yamaji et al.
6,064,842 A 5/2000 Takeuchi et al.
6,070,028 A 5/2000 Odagawa et al.
6,075,957 A 6/2000 Batori et al.
6,101,354 A 8/2000 Nakagawa et al.
6,104,894 A 8/2000 Sato et al.
6,118,961 A 9/2000 Nomura et al.
6,131,007 A 10/2000 Yamaguchi et al.
6,160,976 A 12/2000 Karakama et al.
6,185,390 B1 2/2001 Higeta et al.
6,188,856 B1 2/2001 Sato
6,253,036 B1 6/2001 Karakama et al.
6,266,500 B1 7/2001 Numagami et al.
6,330,402 B1 12/2001 Sakurai et al.
6,381,420 B1 4/2002 Sato et al.
6,397,017 B1 5/2002 Sakai et al.
6,397,018 B1 5/2002 Matsumoto et al.
6,408,142 B1 6/2002 Takeuchi et al.
6,408,143 B2 6/2002 Sakurai et al.
6,424,811 B1 7/2002 Tsuda et al.
6,463,223 B1 10/2002 Karakama et al.
6,519,431 B1 2/2003 Toba et al.
6,542,706 B2 4/2003 Toba et al.
6,549,736 B2 4/2003 Miyabe et al.
6,594,454 B2 7/2003 Oguma et al.
6,603,939 B1 8/2003 Toba et al.
6,625,413 B2 9/2003 Oguma et al.
6,640,066 B2 10/2003 Sato
6,654,567 B2 11/2003 Karakama et al.
6,658,224 B2 12/2003 Yokoi et al.
6,678,488 B2 1/2004 Toba et al.
6,697,578 B2 2/2004 Watanabe et al.
6,701,107 B2 3/2004 Karakama et al.
6,704,525 B2 3/2004 Oguma et al.
6,714,749 B2 3/2004 Sato et al.
6,738,589 B2 5/2004 Karakama et al.
6,782,213 B2 8/2004 Watanabe et al.
6,782,222 B2 8/2004 Ito et al.
6,804,475 B2 10/2004 Oguma et al.
6,804,483 B2 10/2004 Yokoi et al.
6,826,380 B2 11/2004 Karakama et al.
6,832,056 B2 12/2004 Watanabe et al.
6,836,629 B2 12/2004 Miyabe et al.
6,836,639 B2 12/2004 Karakama et al.
6,859,627 B2 2/2005 Karakama et al.
6,892,035 B2 5/2005 Matsumoto et al.
6,895,199 B2 5/2005 Sato et al.
6,898,392 B2 5/2005 Karakama et al.
6,898,399 B2 5/2005 Morioka et al.
6,937,832 B2 8/2005 Sato et al.
6,937,834 B2 8/2005 Kanno et al.
6,987,938 B2 1/2006 Murakami et al.
6,990,302 B2 1/2006 Toba et al.
7,003,247 B2 2/2006 Koishi et al.
7,024,131 B2 4/2006 Komatsu et al.
7,072,601 B2 7/2006 Kakitani et al.
7,073,251 B2 7/2006 Kikuchi et al.
7,082,276 B2 7/2006 Karakama et al.
7,095,967 B2 8/2006 Karakama et al.
7,136,604 B2 11/2006 Chadani et al.
7,139,502 B2 11/2006 Koishi et al.
7,149,457 B2 12/2006 Miyabe et al.
7,155,140 B2 12/2006 Arimitsu et al.
7,155,141 B2 12/2006 Sato et al.
7,158,736 B2 1/2007 Sato et al.
7,158,749 B2 1/2007 Ueno et al.
7,164,875 B2 1/2007 Miyabe et al.
7,184,690 B2 2/2007 Ueno et al.
7,200,349 B2 4/2007 Sato et al.
7,212,768 B2 5/2007 Numagami et al.
7,218,882 B2 5/2007 Toba
7,224,925 B2 5/2007 Sato et al.
7,248,810 B2 7/2007 Miyabe et al.
7,266,326 B2 9/2007 Karakama et al.
7,283,766 B2 10/2007 Arimitsu et al.
7,296,341 B2 11/2007 Kikuchi et al.
7,315,710 B2 1/2008 Ueno et al.
7,349,657 B2 3/2008 Sato et al.
7,412,193 B2 8/2008 Sato et al.
7,457,566 B2 11/2008 Koishi et al.
7,499,663 B2 3/2009 Sato et al.
7,660,550 B2 2/2010 Mori et al.
7,689,146 B2 3/2010 Sato et al.
7,715,746 B2 5/2010 Tanabe et al.
7,720,408 B2 5/2010 Ueno et al.
7,813,668 B2 10/2010 Ueno et al.
7,813,671 B2 10/2010 Nittani et al.
7,856,192 B2 12/2010 Koishi et al.
7,860,433 B2 12/2010 Toba et al.
7,890,012 B2 2/2011 Koishi et al.
7,894,733 B2 2/2011 Tanabe et al.
7,912,404 B2 3/2011 Hoshi et al.
7,953,340 B2 5/2011 Tanabe et al.
7,991,333 B2 * 8/2011 Sato ..... G03G 15/0886
399/111
8,139,979 B2 3/2012 Koishi et al.
8,155,553 B2 4/2012 Takarada
8,213,831 B2 7/2012 Toba et al.
8,249,485 B2 8/2012 Horikawa et al.
8,301,054 B2 10/2012 Tanabe et al.
8,515,306 B2 8/2013 Kawai et al.
8,521,060 B2 8/2013 Numata et al.
8,526,841 B2 9/2013 Koishi et al.
8,712,284 B2 4/2014 Toba et al.
8,862,015 B2 10/2014 Koishi et al.
8,879,944 B2 11/2014 Takarada et al.
9,052,675 B2 6/2015 Takarada et al.
9,134,696 B2 9/2015 Sato et al.
9,213,266 B2 12/2015 Toba
9,274,489 B2 3/2016 Takarada et al.
9,304,488 B2 4/2016 Toba et al.
9,367,025 B2 6/2016 Takarada et al.
9,383,720 B1 7/2016 Fukamachi et al.
9,395,679 B2 7/2016 Kawakami et al.
9,423,767 B2 8/2016 Fujino et al.
9,429,877 B2 8/2016 Sato et al.
9,429,906 B2 8/2016 Yoshimura et al.
9,501,031 B2 11/2016 Hayashi et al.
9,529,298 B2 12/2016 Sato et al.
9,632,451 B2 4/2017 Hayashi et al.

(56) References Cited

U.S. PATENT DOCUMENTS

| | | | | |
|---|---|---|---|---|
| 9,688,008 | B2 | 6/2017 | Takarada et al. | |
| 9,733,612 | B2 | 8/2017 | Toba et al. | |
| 9,791,825 | B2 | 10/2017 | Kamoshida et al. | |
| 9,804,560 | B2 | 10/2017 | Sato et al. | |
| 9,817,338 | B2 | 11/2017 | Hoshi et al. | |
| 9,823,619 | B2 | 11/2017 | Kawakami et al. | |
| 9,836,020 | B2 | 12/2017 | Yoshimura et al. | |
| 9,885,974 | B2 | 2/2018 | Sato et al. | |
| 2006/0008289 | A1 | 1/2006 | Sato et al. | |
| 2010/0080610 | A1 | 4/2010 | Yoshizumi | |
| 2012/0201567 | A1 | 8/2012 | Toba et al. | |
| 2016/0370757 | A1 | 12/2016 | Sato et al. | |
| 2017/0160697 | A1* | 6/2017 | Sato ..... | G03G 21/1633 |
| 2017/0261926 | A1 | 9/2017 | Kashiide et al. | |
| 2017/0261927 | A1 | 9/2017 | Sato et al. | |
| 2017/0267445 | A1 | 9/2017 | Koishi et al. | |
| 2017/0371296 | A1 | 12/2017 | Kamoshida et al. | |
| 2018/0017936 | A1 | 1/2018 | Sato et al. | |
| 2018/0039206 | A1 | 2/2018 | Hioshi et al. | |
| 2018/0046133 | A1 | 2/2018 | Kawakami et al. | |
| 2018/0067452 | A1 | 3/2018 | Yoshimura et al. | |
| 2018/0074454 | A1 | 3/2018 | Uneme et al. | |

* cited by examiner

CARTRIDGE WITH RESTRICTION MEMBER FOR RESTRICTING RELATIVE MOVEMENT OF TONER CARTRIDGE AND PROCESS CARTRIDGE

BACKGROUND OF THE INVENTION

Field of the Invention

The present invention relates to an electrophotographic image forming apparatus employing a cartridge system.

Description of the Related Art

As electrophotographic image forming apparatuses (hereinafter called image forming apparatuses) such as copiers and printers employing a so-called cartridge system, known image forming apparatuses are of a replenishment type in which toner is replenished using a toner cartridge detachably attachable to a process cartridge. Such a replenishment type process cartridge may result in the miniaturization of a cartridge in which the process cartridge and a toner cartridge are combined together. This is because toner may be replenished in a divided manner by an amount corresponding to the life of the process cartridge and thus a toner accommodation portion may be miniaturized with a reduction in an amount of the toner accommodated at a time.

Meanwhile, as a sales form of a cartridge-type image forming apparatus, an image forming apparatus with a cartridge attached to an apparatus body in advance is on the market so that a user is allowed to use the image forming apparatus immediately after purchasing the same. In this form, it is necessary to attach a process cartridge with a toner cartridge attached thereto in advance to an image forming apparatus body at a body assembling factory and deliver the same to a sales store or a user. However, there is a likelihood that the toner cartridge attached to the process cartridge deviates from its regular attachment position due to vibration or an impact caused at transport. As a related art for preventing the problem, a configuration in which a toner cartridge attached to a process cartridge is fixed by an engagement member has been disclosed (Japanese Patent No. 3086763).

SUMMARY OF THE INVENTION

However, an apparatus described in Japanese Patent No. 3086763 is configured to release the fixation of a toner cartridge by an engagement member when the use of toner inside the toner storage portion of a process cartridge is detected, which may cause the upsize of the apparatus or an increase in the number of components.

It is an object of the present invention to provide a technology that makes it possible to release the fixation of a toner cartridge with respect to a process cartridge with a simple configuration in a state in which a cartridge is attached to an image forming apparatus body.

In order to achieve the above object, an embodiment of the present invention provides a cartridge detachably attachable to an apparatus body of an image forming apparatus, comprising:

a toner cartridge that accommodates toner;

a process cartridge that has an attachment portion to which the toner cartridge is detachably attached;

a restriction member provided on the toner cartridge, the restriction member being movable between a restriction position, at which relative movement between (1) the toner cartridge attached to the attachment portion of the process cartridge and (2) the process cartridge is restricted by an engagement of the restriction member and the process cartridge, and a non-restriction position, at which the relative movement is not restricted; and a driving transmission unit for transmitting a driving force from the apparatus body to the toner cartridge by engaging with the apparatus body, wherein, the restriction member has a driving force reception portion that is capable of receiving the driving force from the driving transmission unit by engaging with the driving transmission unit, and wherein, the restriction member moves from the restriction position to the non-restriction position when the driving force reception unit receives the driving force from the driving transmission unit.

In order to achieve the above object, another embodiment of the present invention provides an image forming apparatus comprising:

an apparatus body; and the cartridge.

In order to achieve the above object, another embodiment of the present invention provides an image forming apparatus comprising:

a toner cartridge that accommodates toner and is detachably attachable to an apparatus body;

a process unit that has an attachment portion to which the toner cartridge is detachably attached;

a restriction member provided on the toner cartridge, the restriction member being movable between a restriction position, at which relative movement between (1) the toner cartridge attached to the attachment portion of the process unit and (2) the process unit is restricted by an engagement of the restriction member and the process cartridge, and a non-restriction position, at which the relative movement is not restricted; and a driving transmission unit for transmitting a driving force from the apparatus body to the toner cartridge by engaging with the apparatus body, wherein, the restriction member has a driving force reception portion that is capable of receiving the driving force from the driving transmission unit by engaging with the driving transmission unit, and wherein, the restriction member moves from the restriction position to the non-restriction position when the driving force reception unit receives the driving force from the driving transmission unit.

According to an embodiment of the present invention, it is possible to provide a technology that makes it possible to release the fixation of a toner cartridge with respect to a process cartridge with a simple configuration in a state in which a cartridge is attached to an image forming apparatus body.

Further features of the present invention will become apparent from the following description of exemplary embodiments with reference to the attached drawings.

DESCRIPTION OF THE EMBODIMENTS

Figure 1A:
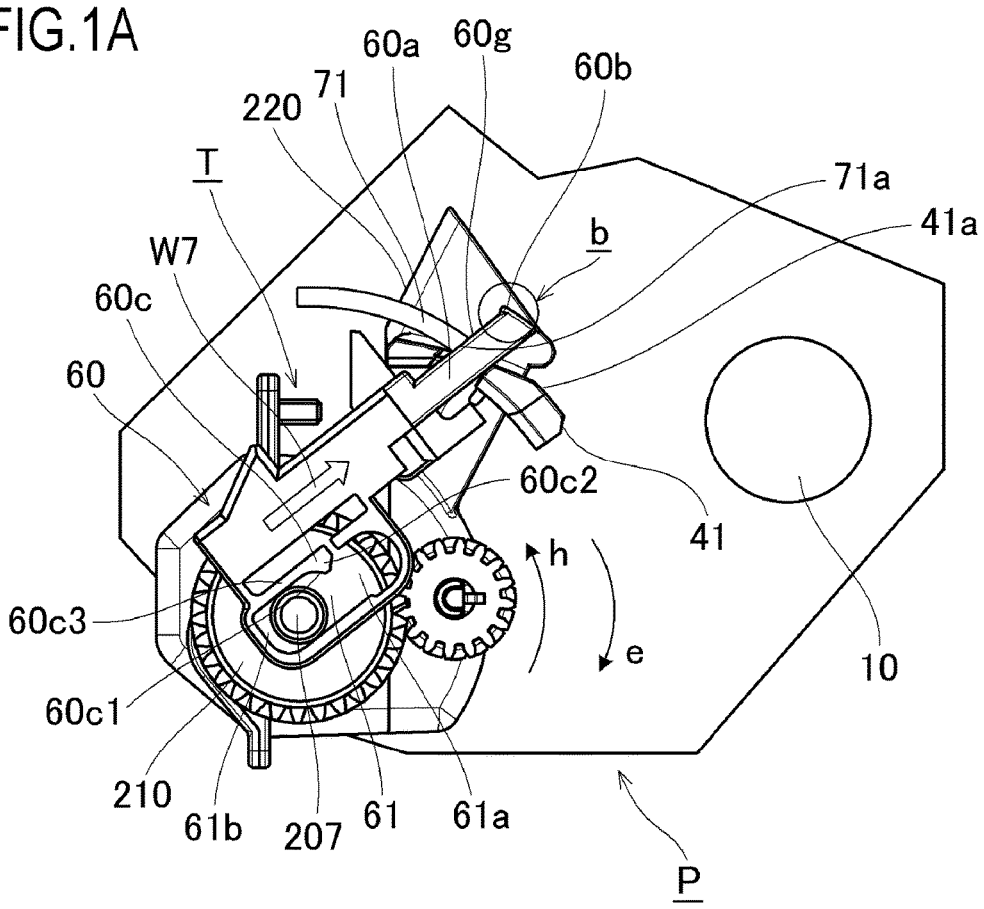
FIGS. 1A and 1B are a side view showing a state in which the attachment of a toner cartridge according to an embodiment is completed and an enlarged view of a b-part in FIG. 1A, respectively.

Hereinafter, a description will be given, with reference to the drawings, of embodiments (examples) of the present invention. However, the sizes, materials, shapes, their relative arrangements, or the like of constituents described in the embodiments may be appropriately changed according to the configurations, various conditions, or the like of apparatuses to which the invention is applied. Therefore, the sizes, materials, shapes, their relative arrangements, or the like of the constituents described in the embodiments do not intend to limit the scope of the invention to the following embodiments.

First Embodiment

A description will be given of a cartridge and an image forming apparatus according to an embodiment of the present invention. Here, the image forming apparatus forms an image on a recording material (recording medium) using an electrophotographic image forming process. Examples of the image forming apparatus include an electrophotographic copier, an electrophotographic printer (such as a laser beam printer and an LED printer), a facsimile machine, a word processor, or the like. Further, a process cartridge is one in which at least one of an electrophotographic photosensitive drum (hereinafter called a photosensitive drum) serving as a photosensitive member and processing means acting on the photosensitive drum is formed as a cartridge, and is detachably attachable to an image forming apparatus body. In the embodiment, the process cartridge is divided into a drum unit having a photosensitive drum and a developing unit having a developing roller, and the respective units are integrally formed as a cartridge. Further, a frame member formed as a cartridge not including a photosensitive drum and processing means and accommodating only a developer (hereinafter called toner) to be consumed with image formation will be called a toner cartridge. The toner cartridge is detachably attachable to the process cartridge or the image forming apparatus body. Hereinafter, the process cartridge and the toner cartridge will be collectively called a cartridge in some cases. Further, the image forming apparatus body is the remaining portion of the image forming apparatus excluding the cartridge.

In the following description, the longitudinal directions of the drum unit, the developing unit, the process cartridge, and the toner cartridge are directions substantially parallel to a rotational axis line L10 (see FIGS. 7A and 7B) of the photosensitive drum and a rotational axis line L9 (see FIG. 7A) of the developing roller. Further, the directions of the rotational axis line L10 of the photosensitive drum and the rotational axis line L9 of the developing roller are directions crossing the transport direction of the recording material. Further, the transverse directions of the drum unit and the developing unit are directions substantially orthogonal to the rotational axis line L10 of the photosensitive drum and the rotational axis line L9 of the developing roller. In the embodiment, a direction in which the process cartridge is attached/detached to/from the image forming apparatus body is the transverse direction of the process cartridge. Further, reference symbols in the description will be given to refer to the drawings and not intend to limit configurations.

(1) Entire Description of Image Forming Apparatus

A description will be given, with reference to FIG. 2, of the entire configuration of an image forming apparatus according to a first embodiment of the present invention.

Figure 2:
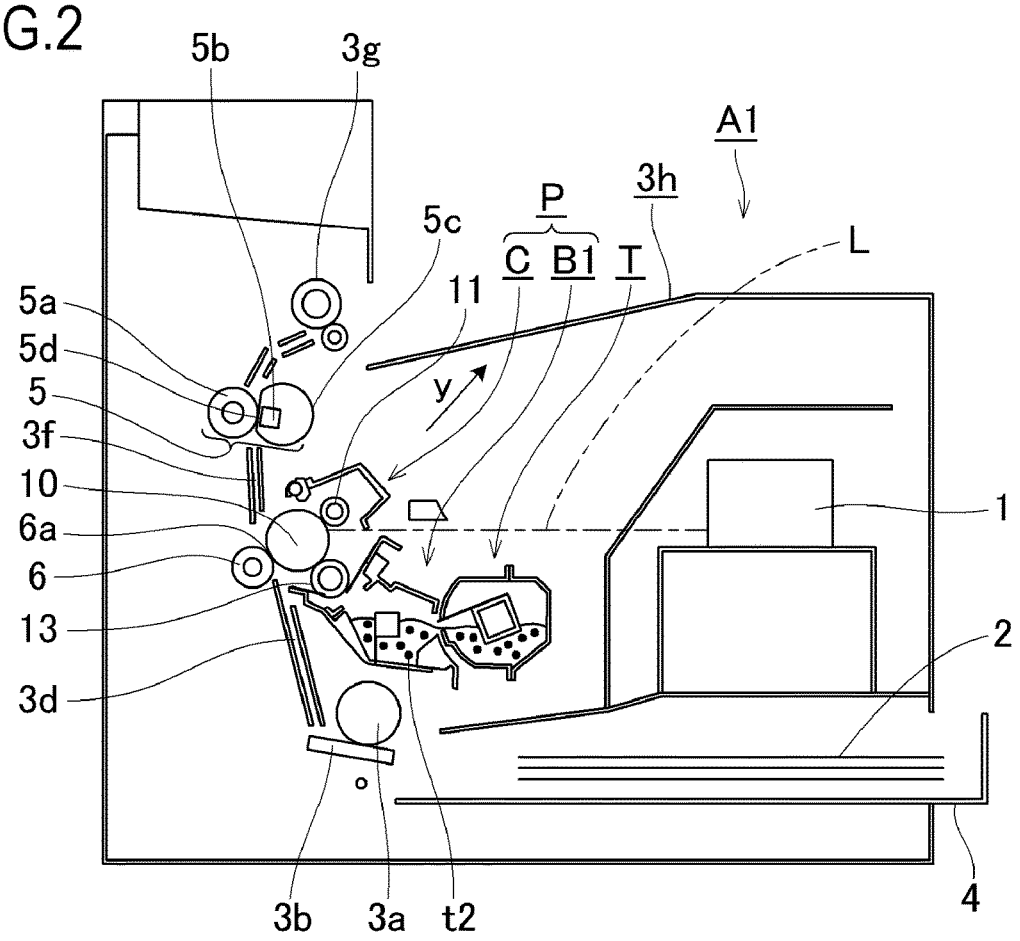
FIG. 2 is a lateral cross-sectional view of an image forming apparatus according to the embodiment.

FIG. 2 is a lateral cross-sectional explanatory view of the image forming apparatus. An image forming apparatus body A1 (the apparatus body of the image forming apparatus) shown in FIG. 2 forms an image by toner t2 on a recording material 2 using an electrophotographic image forming process according to image information transmitted from external equipment such as a personal computer. Further, in the image forming apparatus body A1, a process cartridge P in which a developing unit B1 and a drum unit C are integrated with each other is provided to be detachably attached to the image forming apparatus body A1 by a user. Further, a toner cartridge T is provided to be detachably attachable to the developing unit B1 of the process cartridge P. In the toner cartridge T, a developer (hereinafter called the toner t2) to be supplied to the developing unit B1 is accommodated. Examples of the recording material 2 include a recording sheet, a label sheet, an OHP sheet, fabric, or the like. Further, the developing unit B1 has a developing roller 13 serving as a developer bearing member or the like, and the drum unit C has a photosensitive drum 10 serving as an image bearing member, a charging roller 11, or the like.

The surface of the photosensitive drum 10 is uniformly charged by the charging roller 11 as a voltage is applied from the image forming apparatus body A1. Then, laser light L corresponding to image information is irradiated onto the charged photosensitive drum 10 from optical means 1, and an electrostatic latent image corresponding to the image information is formed on the photosensitive drum 10. The electrostatic latent image is developed through the toner t2 by the developing means that will be described later, and a developer image is formed on the surface of the photosensitive drum 10. On the other hand, the recording material 2 accommodated in a sheet feeding tray 4 is restricted by a sheet feeding roller 3*a* and a separation pad 3*b* pressed against the sheet feeding roller 3*a* and independently separated and fed in synchronization with the formation of the developer image. Then, the recording material 2 is transported to a transfer roller 6 serving as transfer means by a transport guide 3*d*. The transfer roller 6 is urged to contact the surface of the photosensitive drum 10. Next, the recording material 2 passes through a transfer nip portion 6*a* formed by the photosensitive drum 10 and the transfer roller 6. At this time, the developer image formed on the surface of the photosensitive drum 10 is transferred onto the recording material 2 by the application of a voltage having polarity opposite to that of the developer image to the transfer roller 6. The recording material 2 with the transferred developer image is restricted by a transport guide 3*f* and transported to fixing means 5. The fixing means 5 has a driving roller 5*a* and a fixing roller 5*c* including a heater 5*b*. Then, heat and pressure are applied to the recording material 2 when the recording material 2 passes through a nip portion 5*d* formed by the driving roller 5*a* and the fixing roller 5*c*, and the developer image transferred onto the recording material 2 is fixed onto the recording material 2. Thus, an image is formed on the recording material 2. After that, the recording material 2 is transported by a pair of discharge rollers 3*g* and discharged to a discharge portion 3*h*.

(2) Description of Electrophotographic Image Forming Process

Figure 3:
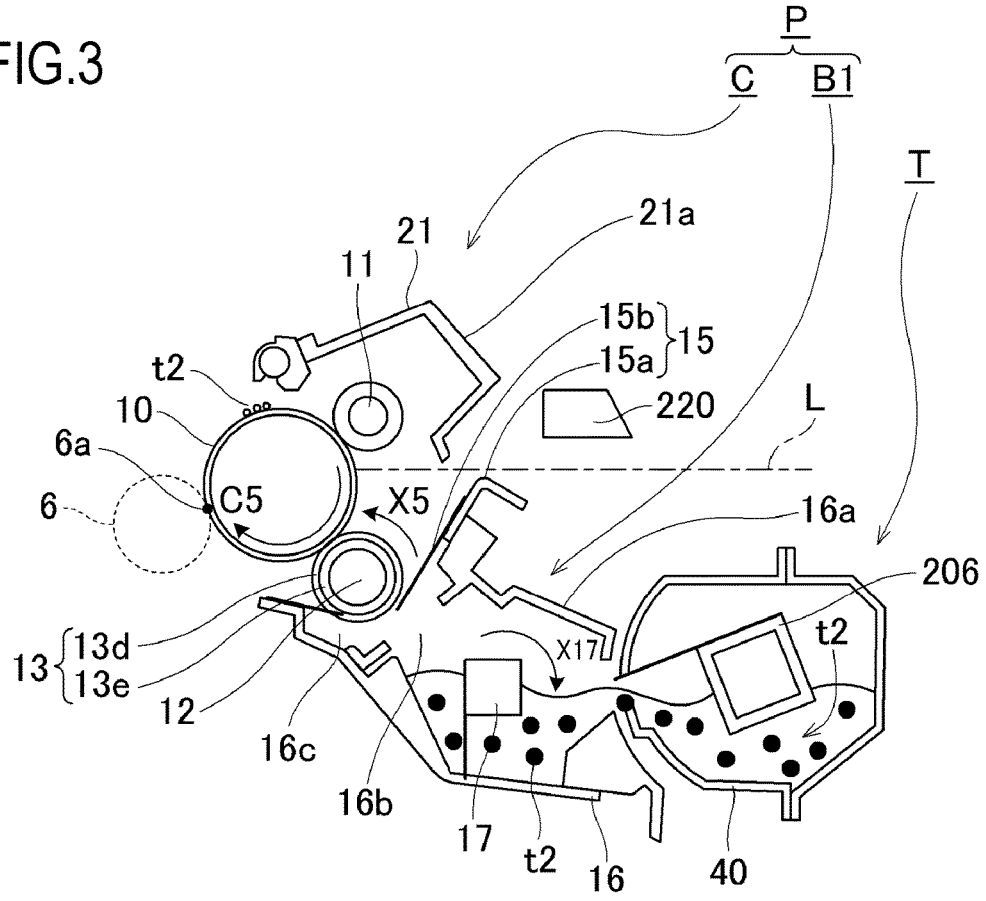
FIG. 3 is a lateral cross-sectional view of a process cartridge and the toner cartridge according to the embodiment.

A description will be given, with reference to FIG. 3, of an electrophotographic image forming process. FIG. 3 is a cross-sectional explanatory view of the process cartridge P and the toner cartridge T. As shown in FIG. 3, the developing unit B1 has the developing roller 13 serving as developing means, a developing blade 15, or the like on a developing frame member 16 serving as a developing frame member. Further, the drum unit C has the photosensitive drum 10, the charging roller 11, or the like on a drum supporting frame member 21. The toner t2 accommodated in a developer accommodation portion 16*a* of the developing frame member 16 is discharged into a developing chamber 16*c* via a developing frame member opening portion 16*b* of the developing frame member 16 when a developer transport member 17 rotatably supported by the developing frame member 16 rotates in the direction of an arrow X17. On the developing frame member 16, the developing roller 13 including a magnet roller 12 is provided. Specifically, the developing roller 13 is composed of a shaft portion 13*e* and a rubber portion 13*d*. The shaft portion 13*e* has a long cylindrical shape made of aluminum or the like having conductivity, and is coated with the rubber portion 13*d* at a central portion in its longitudinal direction. Here, the rubber portion 13*d* is coated on the shaft portion 13*e* so that its external shape becomes a peripheral surface shape coaxial with the shaft portion 13*e*. The developing roller 13 attracts the toner t2 of the developing chamber 16*c* onto its surface by the magnetic force of the magnet roller 12. Further, the developing blade 15 is composed of a support member 15*a* made of a plate and an elastic member 15*b* made of urethane rubber, SUS, or the like, and so provided that the elastic member 15*b* elastically contacts the developing roller 13 with fixed contact pressure. Then, an amount of the toner t2 attached onto the surface of the developing roller 13 is regulated when the developing roller 13 rotates in a rotating direction X5, and the toner t2 is given triboelectric charges. Thus, a toner layer is formed on the surface of the developing roller 13. Then, the toner t2 is supplied to the developing region of the photosensitive drum 10 when the developing roller 13 with a voltage applied thereto from the image forming apparatus body A1 rotates in the rotating direction X5 in a state of contacting the photosensitive drum 10.

On the outer peripheral surface of the photosensitive drum 10, the charging roller 11 rotatably supported by the drum supporting frame member 21 and urged in the direction of the photosensitive drum 10 is provided to contact. The detailed configuration of the charging roller 11 will be described later. The charging roller 11 uniformly charges the surface of the photosensitive drum 10 as a voltage is applied from the image forming apparatus body A1 to the charging roller 11. The voltage to be applied to the charging roller 11 is set at a value at which the potential difference between the surface of the photosensitive drum 10 and the charging roller 11 becomes a charging start voltage or more. Specifically, a direct current of −116 dV is applied as a charging bias. At this time, the surface of the photosensitive drum 10 is uniformly charged at a charging potential (dark-portion potential) of −700 V in a contacting manner. Then, an electrostatic latent image is formed on the surface of the photosensitive drum 10 by the laser light L of the optical means 1 (FIG. 2). After that, the toner t2 is moved corresponding to the electrostatic latent image on the photosensitive drum 10 to visualize the electrostatic latent image to form a developer image on the photosensitive drum 10.

(3) Description of Configuration of Developing Unit B1

Figure 4A:
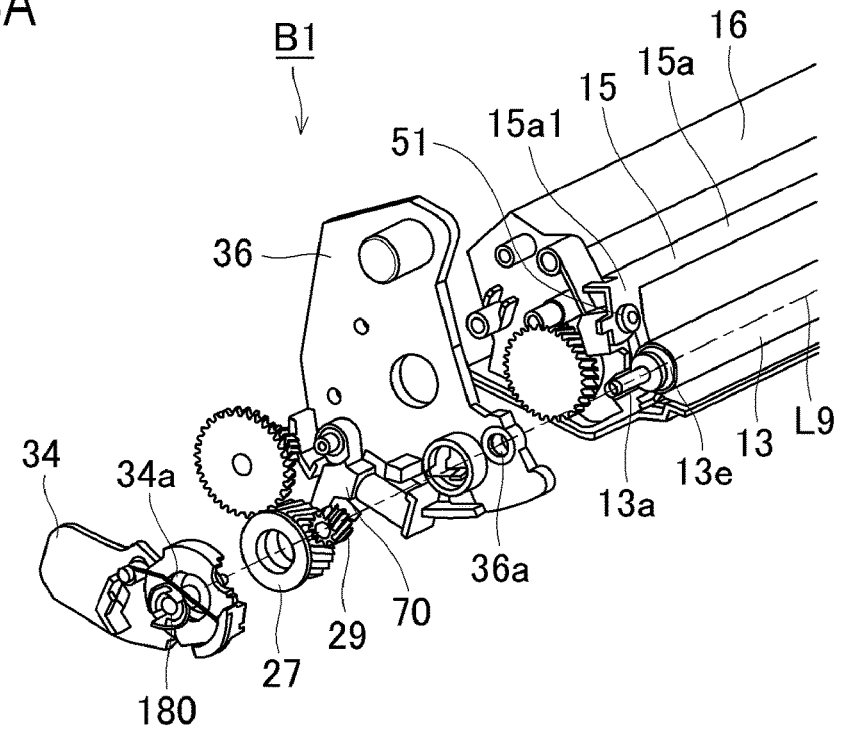
FIGS. 4A and 4B are exploded perspective views of the developing unit on a driving side according to the embodiment.
Figure 4B:
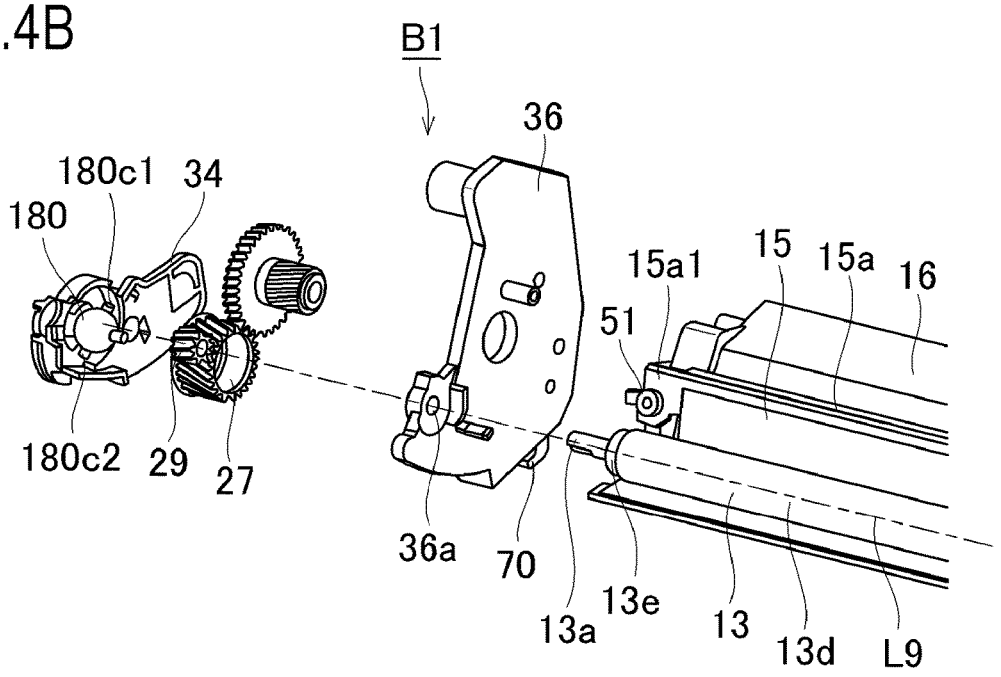
Figure 5A:
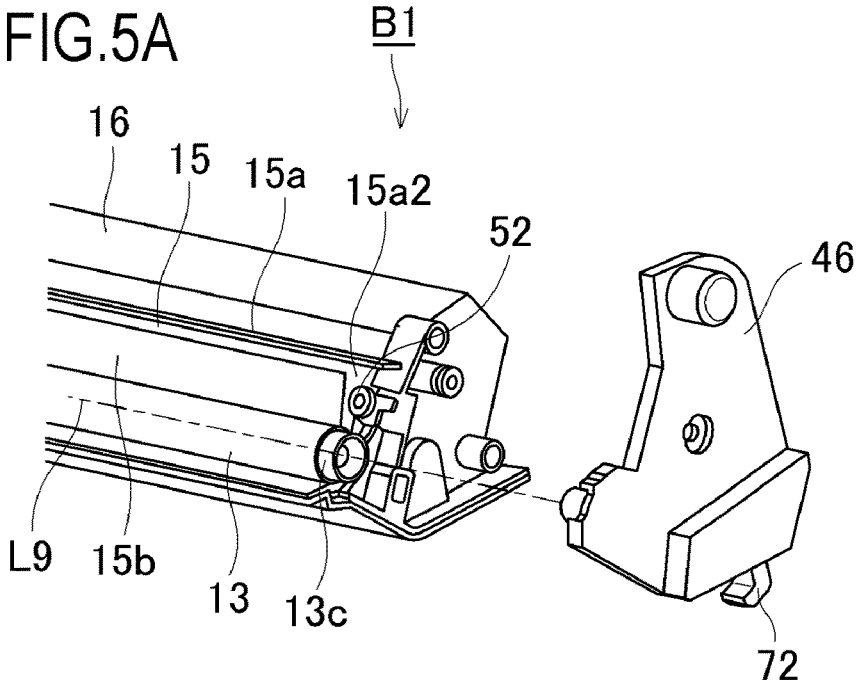
FIGS. 5A and 5B are exploded perspective views of the developing unit on a non-driving side according to the embodiment.
Figure 5B:
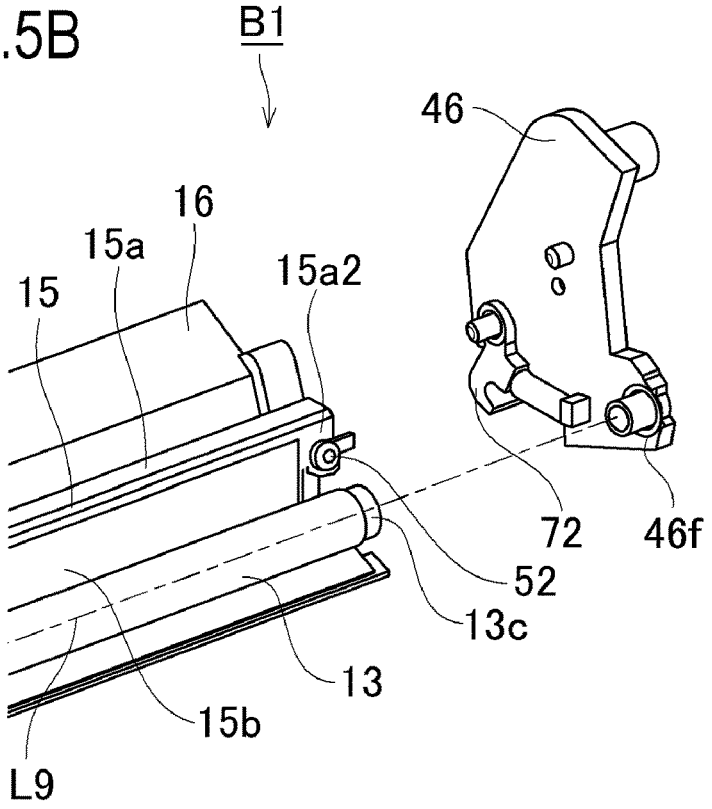

A description will be given, with reference to FIGS. 4A and 4B and FIGS. 5A and 5B, of the configuration of the developing unit B1. Note that in FIGS. 4A and 4B and FIGS. 5A and 5B as well, the longitudinal direction of the developing unit B1 is a direction parallel to the axis line direction of the rotational axis line L9 of the developing roller 13 of the developing unit B1 as described above. Further, one side in the longitudinal direction of the developing unit B1 to which a rotational force is transmitted from the image forming apparatus body A1 will be called a "driving side," whereas the other side thereof in the longitudinal direction will be called a "non-driving side". FIGS. 4A and 4B are exploded perspective explanatory views of the developing unit B1 on the driving side, wherein FIG. 4A is a perspective explanatory view of the developing unit B1 when seen from the driving side, and FIG. 4B is a perspective explanatory view of the developing unit B1 when seen from the non-driving side. FIGS. 5A and 5B are exploded perspective explanatory views of the developing unit B1 on the non-driving side, wherein FIG. 5A is a perspective explanatory view of the developing unit B1 when seen from the non-driving side, and FIG. 5B is a perspective explanatory view of the developing unit B1 when seen from the driving side.

As shown in FIGS. 4A and 4B and FIGS. 5A and 5B, the developing unit B1 has the developing roller 13, the developing blade 15, or the like. A driving-side end 15*a*1 and a non-driving side end 15*a*2 in the longitudinal direction of the support member 15*a* of the developing blade 15 are fastened to the developing frame member 16 by screws 51 and 52, respectively. At both ends in the longitudinal direction of the developing frame member 16, a driving-side developing bearing 36 and a non-driving side developing bearing 46 are arranged, respectively. The developing roller 13 is rotatably supported with its driving-side end 13*a* fitted with a hole 36*a* of the driving-side developing bearing 36 and its non-driving side end 13*c* fitted with a support portion 46*f* of the non-driving side developing bearing 46. Further, at the driving-side end 13*a* of the developing roller 13 and on the outside in the longitudinal direction of the driving-side developing bearing 36, a developing roller gear 29 is arranged to be coaxial with the developing roller 13, and the developing roller 13 and the developing roller gear 29 engage with each other to be integrally rotatable. The driving-side developing bearing 36 rotatably supports a driving input gear 27 on its outside in the longitudinal direction. The driving input gear 27 meshes with the developing roller gear 29. Further, a coupling member 180 is provided to be coaxial with the driving input gear 27.

The developing unit B1 has, at the driving-side outermost end, a developing side cover 34 to coat the driving input gear 27 or the like from the outside in the longitudinal direction. The coupling member 180 protrudes to the outside in the longitudinal direction via a hole 34*a* of the developing side cover 34. The coupling member 180 receives a rotational force by engaging with a body-side driving member (not shown) provided in the image forming apparatus body A1. Further, the rotational force is transmitted to a rotational-force reception portion (not shown) of the driving input gear 27 via rotational-force transmission portions 180*c*1 and 180*c*2 of the coupling member 180. As a result, the rotational force input to the coupling member 180 is transmitted to the developing roller 13 serving as a rotating member via the driving input gear 27 and the developing roller gear 29. Further, the driving-side developing bearing 36 has a driving-side contact/separation lever 70, and the non-driving side developing bearing 46 has a non-driving side contact/separation lever 72.

(4) Description of Configuration of Drum Unit C

Figure 6A:
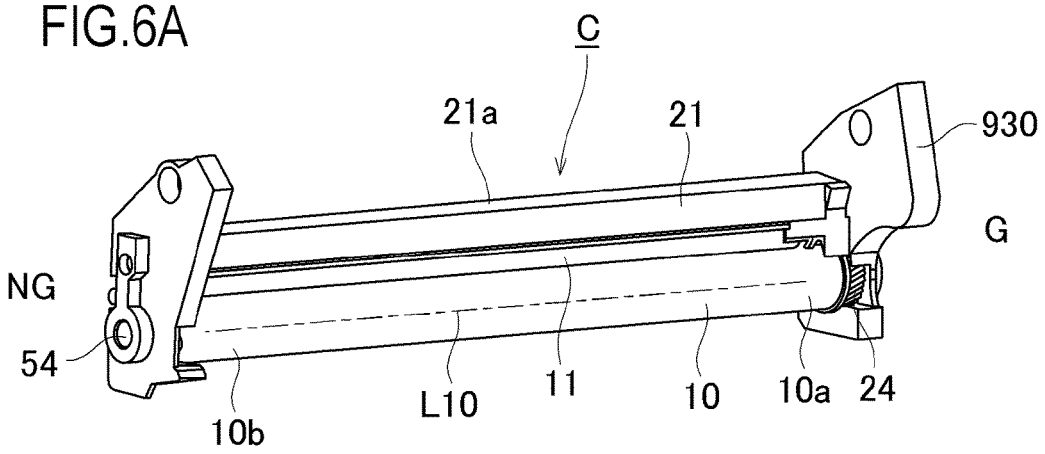
FIGS. 6A and 6B are perspective views of a drum unit according to the embodiment.
Figure 6B:
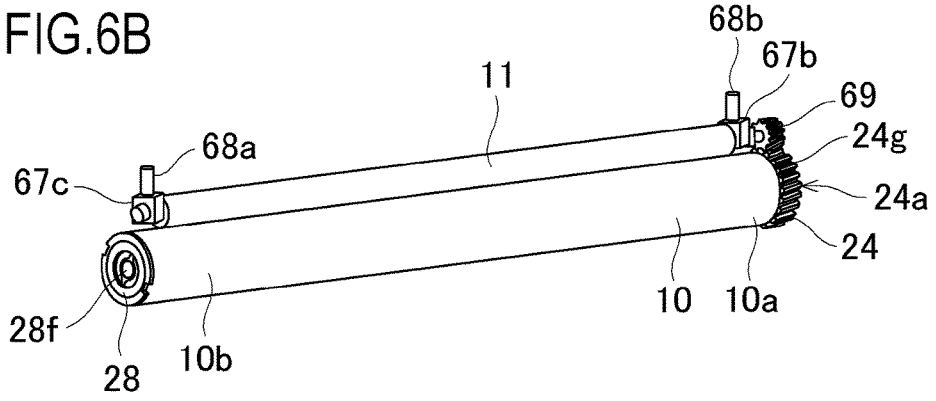

A description will be given, with reference to FIGS. 6A and 6B, of the configuration of the drum unit C. FIG. 6A is a perspective explanatory view of the drum unit C when seen from its non-driving side NG. FIG. 6B is a perspective explanatory view of the drum unit C in which the drum supporting frame member 21, a driving-side drum bearing 930, a drum shaft 54, or the like is not shown to describe the peripheral portions of the photosensitive drum 10 and the charging roller 11. As shown in FIGS. 6A and 6B, the drum unit C has the photosensitive drum 10, the charging roller 11, or the like. The charging roller 11 is rotatably supported by charging roller bearings 67*a* and 67*b*, and urged to the photosensitive drum 10 by charging roller urging members 68*a* and 68*b*.

A driving-side flange 24 is integrally fixed to a driving-side end 10*a* of the photosensitive drum 10, and a non-driving side flange 28 is integrally fixed to a non-driving side end 10*b* of the photosensitive drum 10. The driving-side flange 24 and the non-driving side flange 28 are fixed to be coaxial with the photosensitive drum 10 by means of caulking, bonding, or the like. At both ends in the longitudinal direction of the drum supporting frame member 21, a driving-side drum bearing 930 and a drum shaft 54 are fixed to an end on the driving side G and an end on the non-driving side NG, respectively, by means of screws, bonding, indentation, or the like. The driving-side flange 24 integrally fixed to the photosensitive drum 10 is rotatably supported by the drum bearing 930, and the non-driving side flange 28 is rotatably supported by the drum shaft 54.

Further, a charging roller gear 69 is provided at one end in the longitudinal direction of the charging roller 11, and the charging roller gear 69 meshes with a gear portion 24*g* of the driving-side flange 24. A driving-side end 24*a* of the driving-side flange 24 receives a rotational force from the side of the image forming apparatus body A1 (not shown). As a result, the charging roller 11 is also rotationally driven as the photosensitive drum 10 is rotationally driven. As described above, the peripheral speed of the surface of the charging roller 11 is set at a speed of about 105% to 120% of the peripheral speed of the surface of the photosensitive drum 10.

Further, the drum supporting frame member 21 has a first grip 21*a* serving as a grip gripped by a user to attach the process cartridge P.

Combination of Developing Unit B1 and Drum Unit C

Figure 7A:
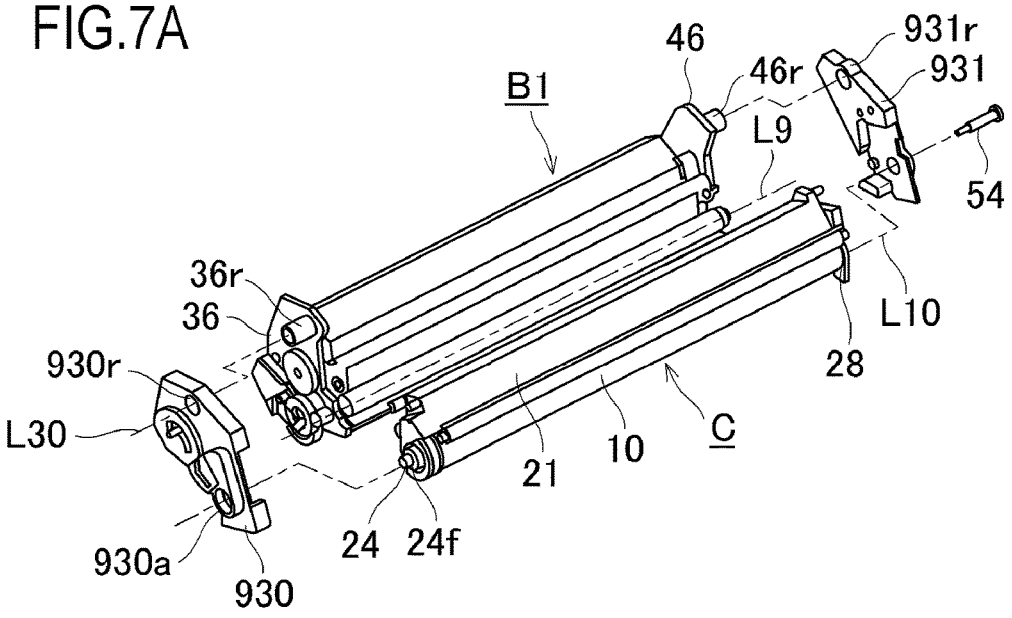
FIGS. 7A and 7B are exploded perspective views of the process cartridge according to the embodiment.
Figure 7B:
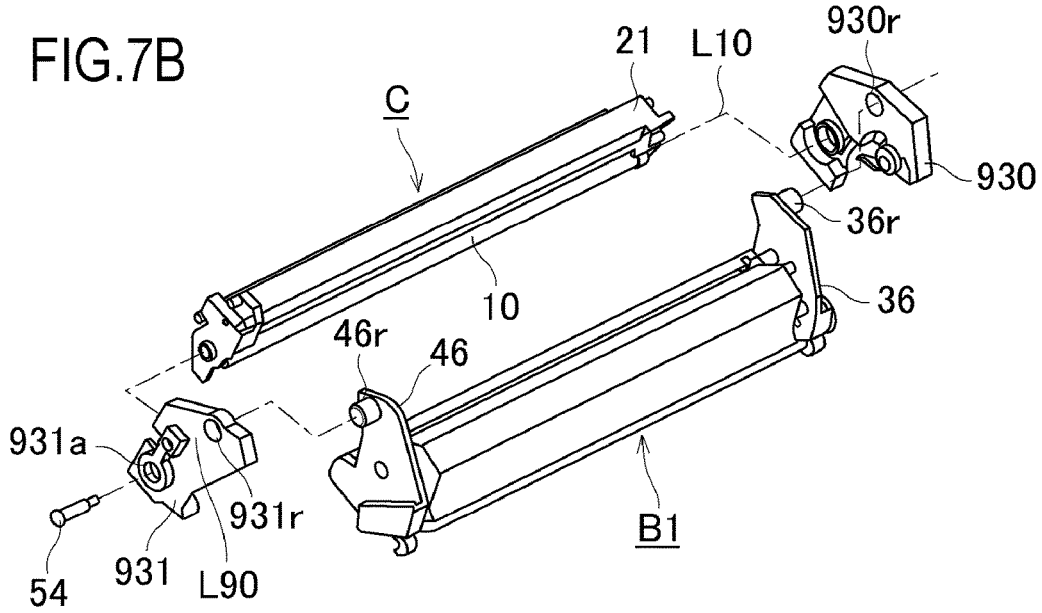

A description will be given, with reference to FIGS. 7A and 7B, of the configuration of combining the developing unit B1 and the drum unit C together to form the process cartridge P. FIG. 7A is a perspective explanatory view of the process cartridge P when seen from the side of photosensitive drum 10. FIG. 7B is a perspective explanatory view of the process cartridge P when seen from the opposite side of the photosensitive drum 10.

As shown in FIGS. 7A and 7B, at both ends in the longitudinal direction of the drum supporting frame member 21, the driving-side drum bearing 930 and a non-driving side drum bearing 931 are provided and fixed to the end on the driving side and the end on the non-driving side, respectively, by means of screws, bonding, indentation, or the like.

Specifically, a supported portion 24*f* of the driving-side flange 24 integrally fixed to the photosensitive drum 10 is rotatably supported by a hole portion 930*a* of the driving-side drum bearing 930. Further, a supported portion 28*f* (FIG. 6B) of the non-driving side flange 28 is rotatably supported by the drum shaft 54 to be coaxial with a hole portion 931*a* of the non-driving side drum bearing 931. Moreover, a suspending boss 36*r* provided on the driving-side developing bearing 36 of the developing unit B1 is rotatably supported by a suspending hole 930*r* provided on the driving-side drum bearing 930. Further, a suspending boss 46*r* provided on the non-driving side developing bearing 46 is rotatably supported by a suspending hole 931*r* provided on the non-driving side drum bearing 931. By the above configuration, the developing unit B1 is swingable with respect to the drum unit C using the suspending boss

36*r* of the driving-side developing bearing 36 and the suspending boss 46*r* of the non-driving side developing bearing 46 as shafts L30 (FIGS. 7A and 7B). At this time, the developing unit B1 is independently (naturally) urged to the drum unit C at all times by developing urging members (for example, helical coil springs) so that the developing roller 13 and the photosensitive drum 10 contact each other (not shown). As a method for urging the developing unit B1, a method for providing springs between the drum unit C and the developing unit B1, a method for using the own weight of the developing unit B1, or the like is assumed but any method may be used.

(5) Detailed Description of Accommodation Portion for Toner Cartridge T of Developing Unit B1

Figure 8A:
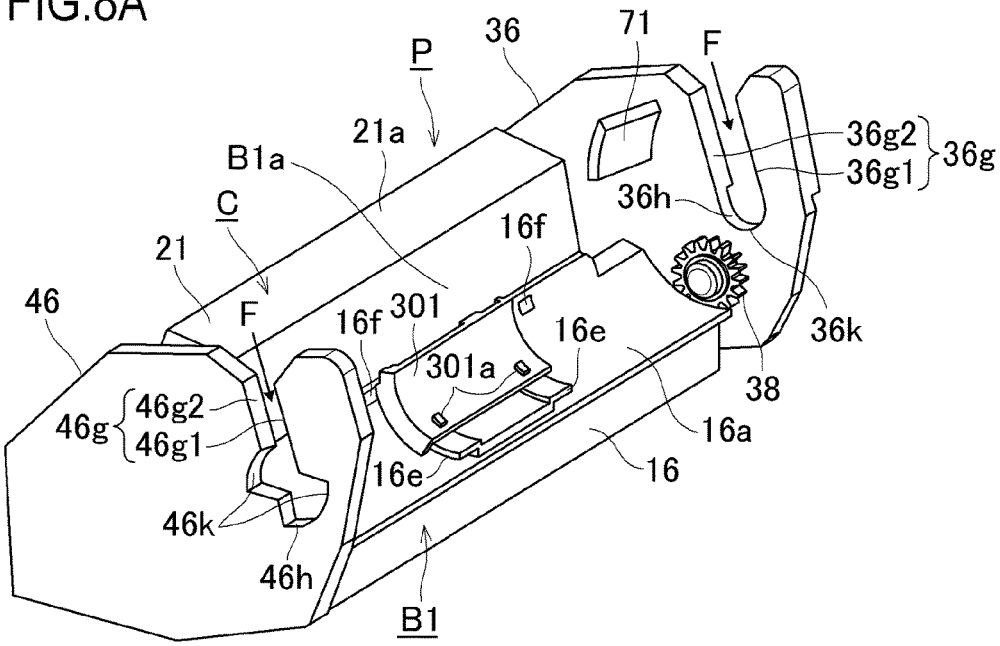
FIGS. 8A and 8B are perspective views of the process cartridge according to the embodiment.
Figure 8B:
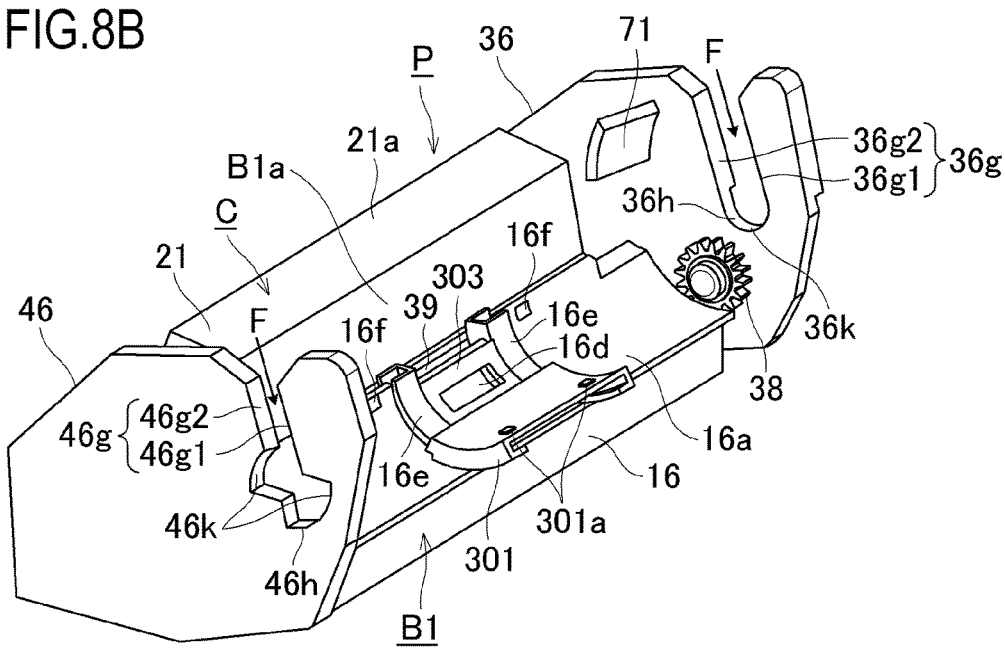

A description will be given, with reference to FIGS. 8A and 8B, of a detailed configuration near an accommodation portion for the toner cartridge T of the developing unit B1 according to the embodiment. FIGS. 8A and 8B are perspective views of the process cartridge P near the accommodation portion for the toner cartridge T, wherein FIG. 8A shows a state in which a developing shutter 301 is closed, and FIG. 8B shows a state in which the developing shutter 301 is opened. The developing unit B1 has a toner cartridge accommodation portion B1*a*. The toner cartridge accommodation portion B1*a* is arranged between the drum supporting frame member 21 and developer accommodation portion 16*a*. Near the toner cartridge accommodation portion B1*a*, a reception opening portion 16*d* and the developing shutter 301 are provided. The reception opening portion 16*d* is provided at a central portion in the longitudinal direction of the developing frame member 16. Note that the position of the reception opening portion 16*d* is not particularly limited to the above position so long as the reception opening portion 16*d* is provided at a position facing a supply opening portion 200 that will be described later. As shown in FIG. 8A, the reception opening portion 16*d* is closed by the developing shutter 301 having a shape with a curvature along the outer peripheral surface of the toner cartridge T that will be described later.

The developing shutter 301 has, on the outside of the sealing range of the reception opening portion 16*d*, hole portions 301*a* that engage protruded portions 40*b* provided on the toner cartridge T that will be described later. The developing shutter 301 engages with developing shutter guide portions 16*e* provided on both ends in the longitudinal direction of the reception opening portion 16*d*. The developing shutter 301 is slidable along the developing shutter guide portions 16*e* between a state (FIG. 8A) in which the reception opening portion 16*d* is closed and a state (FIG. 8B) in which the reception opening portion 16*d* is opened. Further, a reception opening seal 303 that seals between the developing shutter 301 and the reception opening portion 16*d* is attached to the side of the developing frame member 16 to surround the periphery of the reception opening portion 16*d*.

The driving-side developing bearing 36 of the developing unit B1 has an insertion guide 36*g* that guides the insertion track of the toner cartridge T and an abutted portion 36*h* that abuts against an abutment portion 207*a* of the toner cartridge T at the insertion of the toner cartridge T that will be described later. Similarly, the non-driving side developing bearing 46 of the developing unit B1 has an insertion guide 46*g* that guides the insertion track of the toner cartridge T and an abutted portion 46*h* that abuts against an abutment portion 208*a* of the toner cartridge T at the insertion of the toner cartridge T that will be described later. Further, the driving-side developing bearing 36 and the non-driving side developing bearing 46 have, respectively, an opening/closing guide portion 36*k* and an opening/closing guide portion 46*k* that guide the toner cartridge T when the developing shutter 301 and a toner shutter 201 that will be described later are opened/closed. Here, the insertion guides 36*g* and 46*g* are formed to be straight and parallel to each other along an inserting direction F (FIG. 8A) of the toner cartridge T. Further, the abutted portion 36*h* and the opening/closing guide portion 36*k* are provided on a downstream side in the inserting direction F of the insertion guide 36*g*, and the abutted portion 46*h* and the opening/closing guide portion 46*k* are provided on a downstream side in the inserting direction F of the insertion guide 46*g*.

In addition, the developing unit B1 has a first driving transmission portion 38 that transmits driving to toner transport means 206 of the toner cartridge T that will be described later at an end in the longitudinal direction of the developing unit B1. The first driving transmission portion 38 is coupled to the driving mechanism of the image forming apparatus body A1 via a gear inside the developing unit B1 (not shown). Further, the developing unit B1 has hole portions 16*f* on the outside of both ends in the longitudinal direction of the reception opening portion 16*d*. The hole portions 16*f* engage claw portions 201*b* of snap fit portions 201*a* provided on the toner shutter 201 of the toner cartridge T that will be described later, and prevent the toner shutter 201 from moving together with a toner frame member 40 that will be described later when the toner shutter 201 is closed.

(6) Description of Configuration of Toner Cartridge T

Figure 9A:
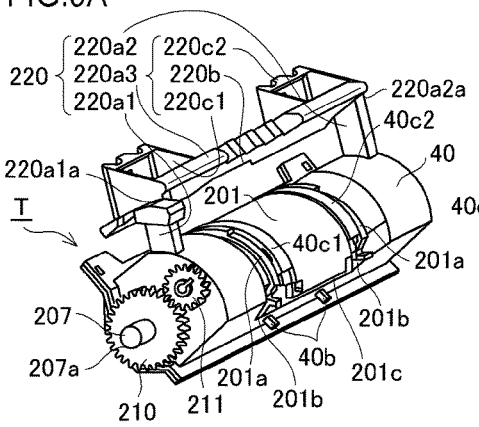
FIGS. 9A to 9D are explanatory views of the toner cartridge according to the embodiment.
Figure 9B:
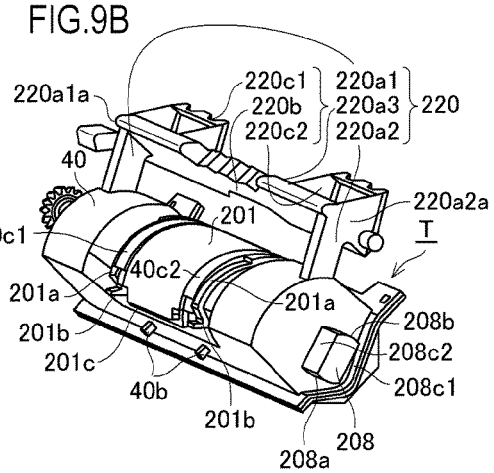
Figure 9C:
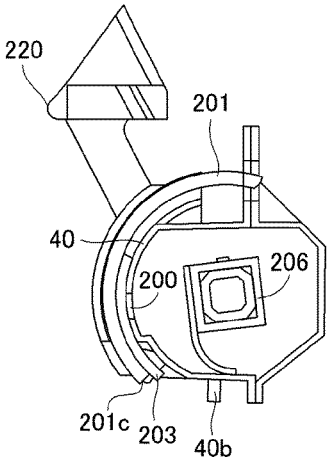
Figure 9D:
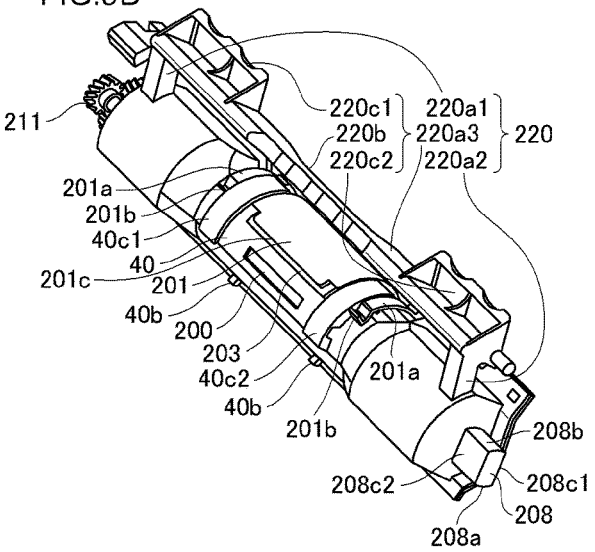

A description will be given, with reference to FIGS. 9A to 9D, of the detailed configuration of the toner cartridge T according to the embodiment. FIG. 9A is a perspective view of the toner cartridge T when seen from its driving side, and FIG. 9B is perspective view of the toner cartridge T when seen from a side opposite to the driving side. FIG. 9C is a cross-sectional view of the toner cartridge T when seen from the side opposite to the driving side, and FIG. 9D is a perspective view showing a state a state in which the toner shutter 201 of the toner cartridge T is opened. The toner cartridge T has the toner frame member 40, the supply opening portion 200, and the toner shutter 201. In addition, a toner discharge port seal 203 that seals between the toner frame member 40 and the toner shutter 201 when the toner shutter 201 is placed at a position at which the supply opening portion 200 is closed is attached to the toner shutter 201 to coat the supply opening portion 200.

The toner frame member 40 has a hollow and substantially cylindrical shape, and has the protruded portions 40*b* that engage with the hole portions 301*a* of the developing shutter 301 on its outer periphery. Inside the toner frame member 40, the toner transport means 206 for transporting the toner is provided. The toner transport member 206 has, at its one end, a toner transport driving transmission member 210 that drives the toner transport member 206 and a second driving transmission member 211 that transmits the driving of the first driving transmission portion 38 (FIGS. 8A and 8B) of the process cartridge P to the toner transport driving transmission member 210.

The supply opening portion 200 is provided at the center in the longitudinal direction of the toner cartridge T on the circumference of the toner frame member 40. Here, the longitudinal direction of the toner cartridge T is a direction parallel to the direction of the rotational axis line of the toner transport member 206. The position of the supply opening portion 200 is not particularly limited to the above position so long as the supply opening portion 200 is provided at a position facing the reception opening portion 16*d*. Further, the toner shutter 201 has a shape with a curvature along the outer peripheral surface of the toner cartridge T, and has the snap fit portions 201*a* and the claw portions 201*b* at its both ends in the longitudinal direction. The toner shutter 201 engages with toner shutter guide portions 40*c*1 and 40*c*2 provided at both ends in the longitudinal direction of the supply opening portion 200. Further, the toner shutter 201 is slidable in the peripheral direction of the toner frame member 40 between a state (FIG. 9D) in which the supply opening portion 200 is opened and a state (FIG. 9B) in which the supply opening portion 200 is closed along the outer peripheral surface of the toner cartridge T.

In addition, the toner cartridge T has, at its both ends in the longitudinal direction, a positioning boss 207 and an inserted guide portion 208 serving as inserted guide portions to be guided by the insertion guide 36*g* and the insertion guide 46*g* of the developing unit B1, respectively. The positioning boss 207 serving as an inserted guide portion has the abutment portion 207*a* that abuts against the abutted portion 36*h* of the developing unit B1 at the insertion of the toner cartridge T. Further, the inserted guide portion 208 has the abutment portion 208*a* that abuts against the abutted portion 46*h* of the developing unit B1 at the insertion of the toner cartridge T. In addition, the inserted guide portion 208 has an opening/closing guided portion 208*b* that guides the toner cartridge T when the developing shutter 301 and the toner shutter 201 are opened/closed. Moreover, the inserted guide portion 208 has restriction portions 208*c*1 and 208*c*2 that restrict the insertion attitude of the toner cartridge T when the toner cartridge T is inserted.

Note that the abutment portion 207*a* is integrated with the positioning boss 207 serving as an inserted guide portion in the embodiment but the abutment portion 207*a* and the positioning boss 207 may be provided as separate members so long as their functions are satisfied. In addition, the positioning boss 207 serving as an inserted guide portion is provided at the end of the toner transport driving transmission member 210 in the longitudinal direction of the toner transport member 206 in the embodiment but may be provided on the toner frame member 40. Further, the abutment portion 208*a*, the opening/closing guided portion 208*b*, the restriction portion 208*c*1, and the restriction portion 208*c* are integrated with the inserted guide portion 208 in the embodiment but may be provided as separate members so long as their functions are satisfied.

Further, as shown in FIGS. 9A to 9D, the toner frame member 40 has a second grip 220 gripped by the user to attach the toner cartridge T. The second grip 220 is formed into a substantially U-shape composed of one end 220*a*1, the other end 220*a*2, and a substrate 220*a*3. The one end 220*a*1 and the other end 220*a*2 are provided to protrude from one end and the other end, respectively, in the longitudinal direction of the toner frame member 40 in a direction crossing the longitudinal direction. Further, the substrate 220*a*3 is provided along the longitudinal direction of the toner frame member 40 to connect a tip end 220*a*1*a* of the one end 220*a*1 and a tip end 220*a*2*a* of the other end 220*a*2 to each other. In addition, the substrate 220*a*3 has a first grip portion 220*b* and second grip portions 220*c*1 and 220*c*2 to be gripped by the user.

Figure 10:
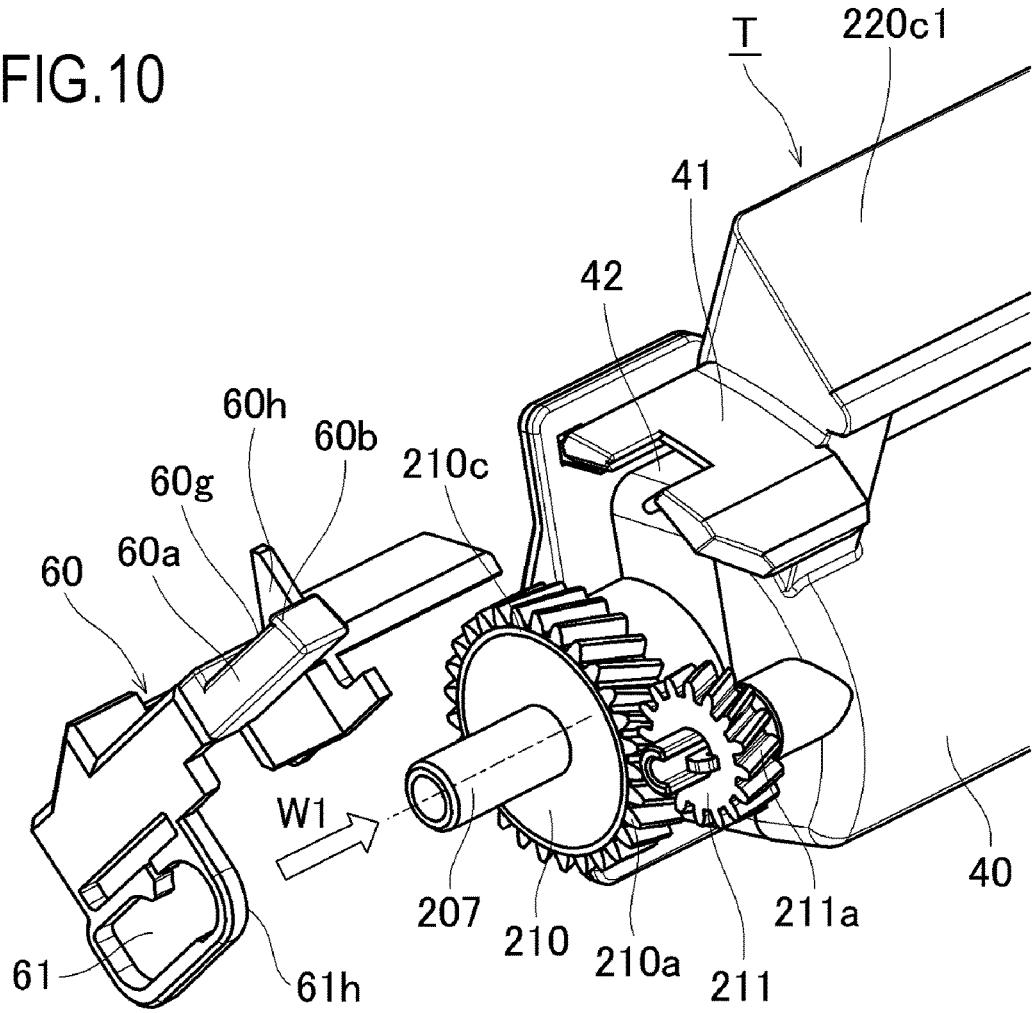
FIG. 10 is a perspective view for describing a method for assembling a rotation locking member according to the embodiment.
Figure 11:
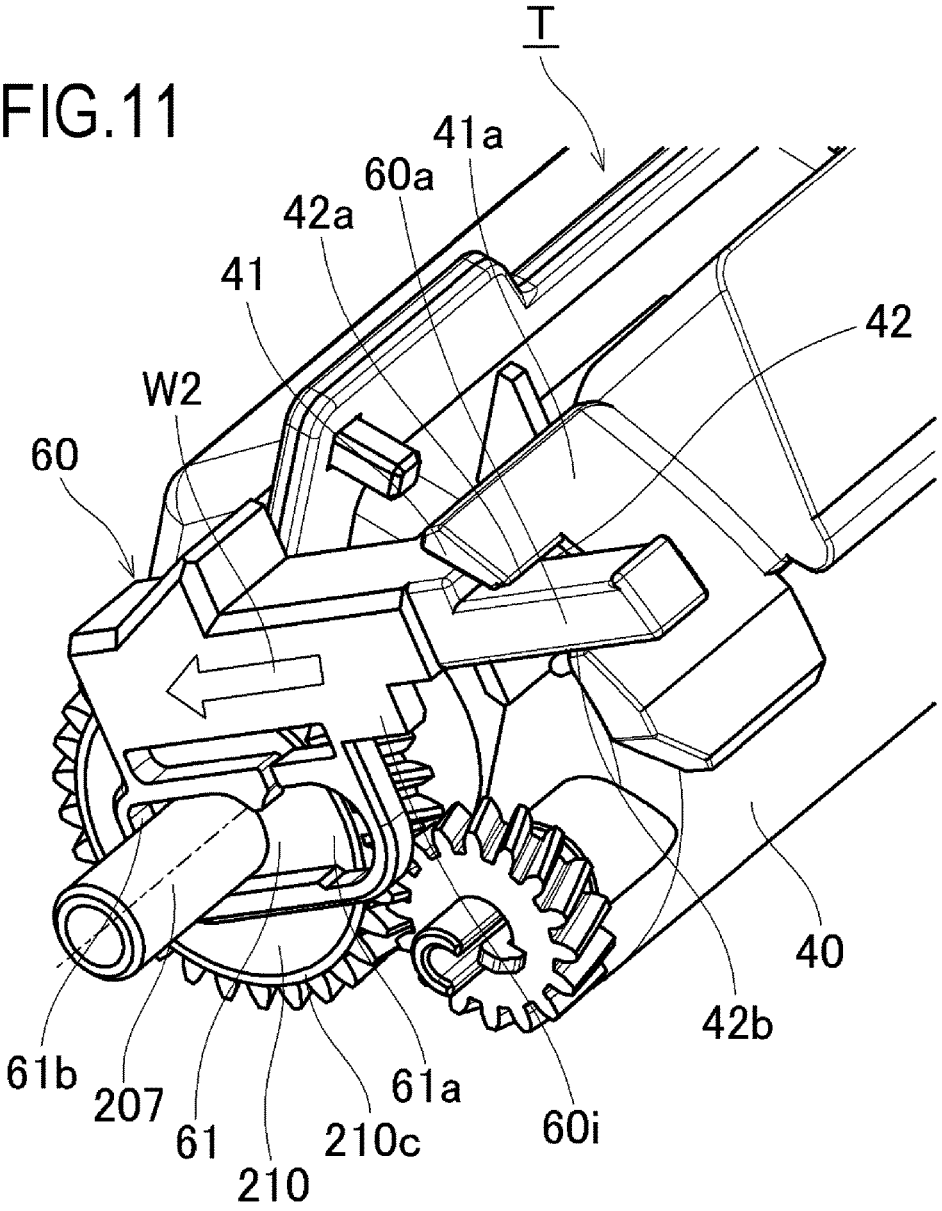
FIG. 11 is a perspective view for describing the method for assembling the rotation locking member according to the embodiment.
Figure 12:
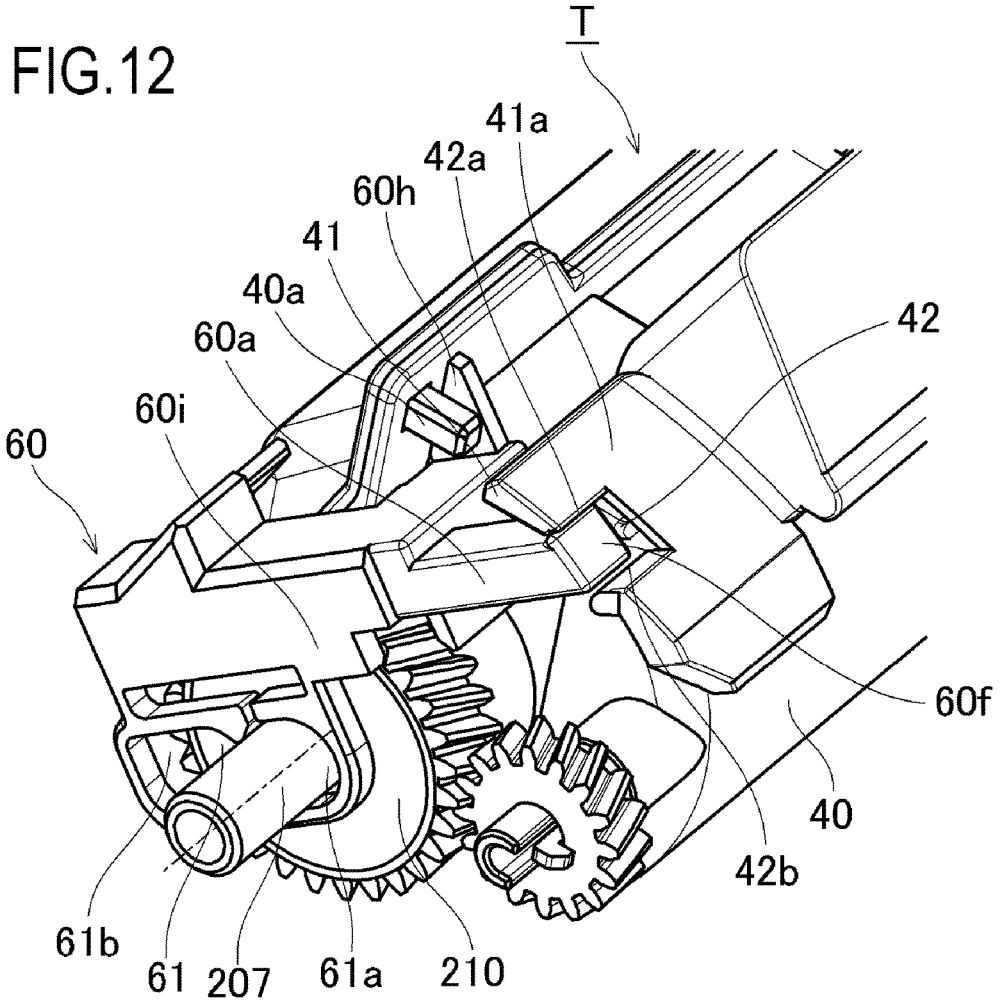
FIG. 12 is a perspective view for describing the method for assembling the rotation locking member according to the embodiment.

(7) Method for Attaching Rotation Locking Member 60 (Position Restriction Member) to Toner Cartridge T A description will be given, with reference to FIGS. 10 to 12, of a method for attaching a rotation locking member 60 serving as a position restriction member to the toner cartridge T as a characteristic portion of the embodiment. FIGS. 10, 11, and 12 are perspective views showing a driving side for describing the method for attaching the rotation locking member 60 serving as a position restriction member to the toner cartridge T. FIG. 12 shows a state in which the attachment of the rotation locking member 60 to the toner cartridge T is completed.

As shown in FIG. 10, the toner frame member 40 rotatably supports the toner transport driving transmission member 210 that transmits a rotational force to the toner transport member 206 (see FIG. 9C) at its driving-side end in the longitudinal direction. Inside the toner frame member 40, the toner transport driving transmission member 210 and the toner transport member 206 (see FIG. 9C) are coupled together to be integrally rotatable. As shown in FIG. 10, the toner frame member 40 rotatably supports the second driving transmission member 211, and a gear portion 211*a* of the second driving transmission member 211 meshes with a gear portion 210*a* of the toner transport driving transmission member 210. The toner transport member 206 (see FIG. 9C) rotates when a driving force received from the image forming apparatus body A1 is transmitted to the toner transport driving transmission member 210 via the second driving transmission member 211. The toner transport driving transmission member 210 has the gear portion 210*a* serving as a driving transmission portion (driving transmission means) and the cylindrical positioning boss 207 extending outside in the longitudinal direction as a positioning portion on the same axis as the rotational axis of the toner transport driving transmission member 210.

Shape of Rotation Locking Member 60 (Position Restriction Member)

Figure 1B:
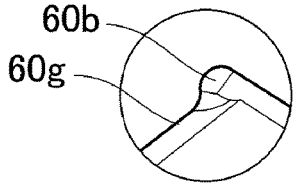

As shown in FIG. 10, the rotation locking member 60 has, with respect to a base member, a rod-shaped bolt pin 60*a* serving as a locking portion at its tip end, a substantially oval-hole-shaped positioning hole 61 at its lateral surface, and an abutment surface 60*h* at its upper portion. The positioning boss 207 engages with the positioning hole 61, and the abutment surface 60*h* is provided to prevent the rotation locking member 60 after being attached to the toner cartridge T from coming off in the longitudinal direction. Further, the bolt pin 60*a* has a protruded portion 60*b* on a bolt-pin upper surface 60*g* at its tip end (see FIG. 1B showing an enlarged view of a b-part in FIG. 1A).

Figure 21A:
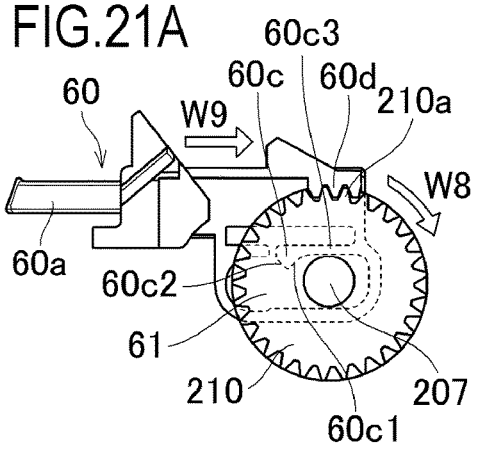
FIGS. 21A to 21C are cross-sectional views for describing a method for disengaging the toner cartridge according to the embodiment.

FIG. 21A is a cross-sectional view obtained when in FIG. 12 a gear tooth plane portion is cut off in a direction orthogonal to the longitudinal direction, wherein the cartridge is seen from its inside in the longitudinal direction. As shown in FIG. 21A, the rotation locking member 60 has a rack 60*d* serving as a driving force reception portion. The rack 60*d* has three teeth. Some portions of the rack 60*d* have teeth (tooth portion 60*d*1) but other portions thereof do not have the teeth (tooth-free portion 60*j*) in the direction of an arrow W9 in FIG. 21A. Further, the rotation locking member 60 has a snap fit portion 60*c*. The snap fit portion 60*c* is composed of an arm 60*c*3, an inclination portion 60*c*1, and a pressing portion 60*c*2. The snap fit portion 60*c* forms a part of the shape of the substantially oval-hole-shaped positioning hole 61 for the engagement of the positioning boss 207.

As shown in FIG. 10, the toner frame member 40 has the second grip portion 220*c*1 that makes the user easily attach/detach the toner cartridge T to/from the process cartridge P. The second grip portion 220*c*1 has, at its driving-side end, an arc-shaped rib 41 protruding toward an outside in the longitudinal direction. The end of the rib 41 has a U-shaped notch portion 42.

Attachment of Rotation Locking Member 60 (Position Restriction Member)

The rotation locking member 60 is attached in the direction of an arrow W1 shown in FIG. 10 from the outside to the inside in the longitudinal direction so that the positioning hole 61 engages with the positioning boss 207 of the toner transport driving transmission member 210 and the bolt pin 60*a* fits into the notch 42.

As the attachment is advanced, an inside surface 61*h* (see FIG. 10) in the longitudinal direction of the rotation locking member 60 finally abuts against an annular rib 210*c* provided on the toner transport driving transmission member 210 as shown in FIG. 11. The positioning hole 61 of the rotation locking member 60 is in engagement with the positioning boss 207 of the toner transport driving transmission member 210. The positioning boss 207 of the toner transport driving transmission member 210 is a support portion that movably supports the rotation locking member 60 serving as a position restriction member. Further, the bolt pin 60*a* of the rotation locking member 60 protrudes from an upper surface 41*a* of the rib 41 and is held between a notch upper surface 42*a* and a notch lower surface 42*b* of the notch 42 of the rib 41. That is, when the rotation locking member 60 attempts to rotate about the cylindrical positioning boss 207, the notch upper surface 42*a* and the notch lower surface 42*b* play a role in restricting the rotation.

In this state, the rotation locking member 60 is moved in the direction of an arrow W2 shown in FIG. 11. The positioning hole 61 has a (front) positioning hole 61*a* when the side of the bolt pin 60*a* is assumed as a front side, and has a (rear) positioning hole 61*b* when a side opposite to the side of the bolt pin 60*a* is assumed as a rear side. As shown in FIG. 12, the positioning boss 207 moves to engage with the (rear) positioning hole 61*b* and the (front) positioning hole 61*a* in this order. A pin tip end 60*f* of the bolt pin 60*a* of the rotation locking member 60 protruding from the upper surface 41*a* of the rib 41 in FIG. 11 is retracted from the upper surface 41*a* as shown in FIG. 12. In a state in which the positioning boss 207 engages with the (front) positioning hole 61*a*, the toner cartridge T may be attached to the process cartridge P.

That is, when the rotation locking member 60 is attached to the toner cartridge T, the rotation locking member 60 is movable in a range shown in FIGS. 11 and 12. Further, the rotation locking member 60 is movable in the above range but may stop with a certain load due to the sliding resistance of each component after its movement.

In a state in which the (front) positioning hole 61*a* engages with the positioning boss 207 as shown in FIG. 12, the abutment surface 60*h* abuts against a boss 40*a* formed on a toner container to restrict the movement of the rotation locking member 60 to the outside in the axial direction of the positioning boss 207. That is, even if the rotation locking member 60 attempts to come off the toner cartridge T to the outside in the axial direction of the positioning boss 207, the abutment surface 60*h* abuts against the boss 40*a* to prevent the rotation locking member 60 from coming off.

Further, as shown in FIG. 12, the rotation locking member 60 has, as another means, a lateral portion 60*i* and a coming-off preventing rib 60*e* (shown in FIG. 21C) facing the lateral portion 60*i* to hold the gear portion 210*a* of the toner transport driving transmission member 210 in a tooth-width direction. The coming-off preventing rib 60*e* does not overlap with the gear portion 210*a* in the axis line direction in the state shown in FIG. 11 but overlaps with the same in the state shown in FIG. 12 to prevent the rotation locking member 60 from coming off the toner cartridge T to the outside in the axial direction of the positioning boss 207.

By these means—the abutment surface 60*h* and the coming-off preventing rib 60*e*, the rotation locking member 60 attached to the toner cartridge T to be replaced at replacement is prevented from coming off in the axial direction of the positioning boss 207. Both the abutment surface 60*h* and the coming-off preventing rib 60*e* are not necessarily provided, but one of the abutment surface 60*h* and the coming-off preventing rib 60*e* is only required to be provided.

(8) Operation of Attaching Toner Cartridge T to Process Cartridge P

First, a description will be given of the operation of inserting the toner cartridge T into the process cartridge P for the engagement between the toner cartridge T and the process cartridge P and the operation of opening the reception opening portion 16*d* and the supply opening portion 200.

Operation of Inserting Toner Cartridge T into Process Cartridge P

Figure 13A:
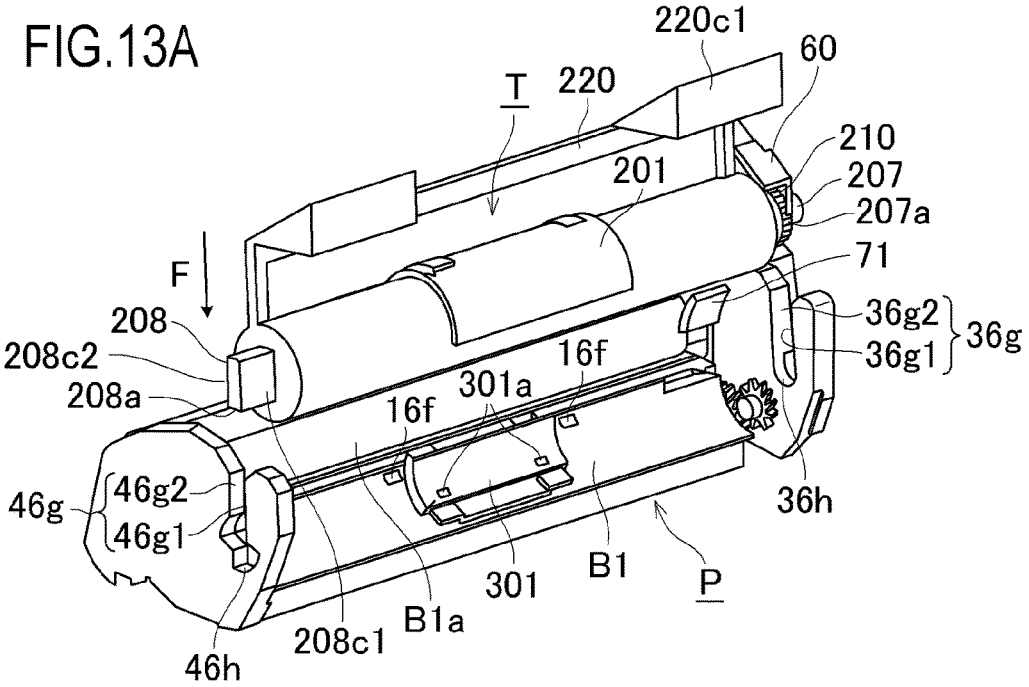
FIGS. 13A and 13B are explanatory views showing a state in which the insertion of the toner cartridge according to the embodiment starts.
Figure 13B:
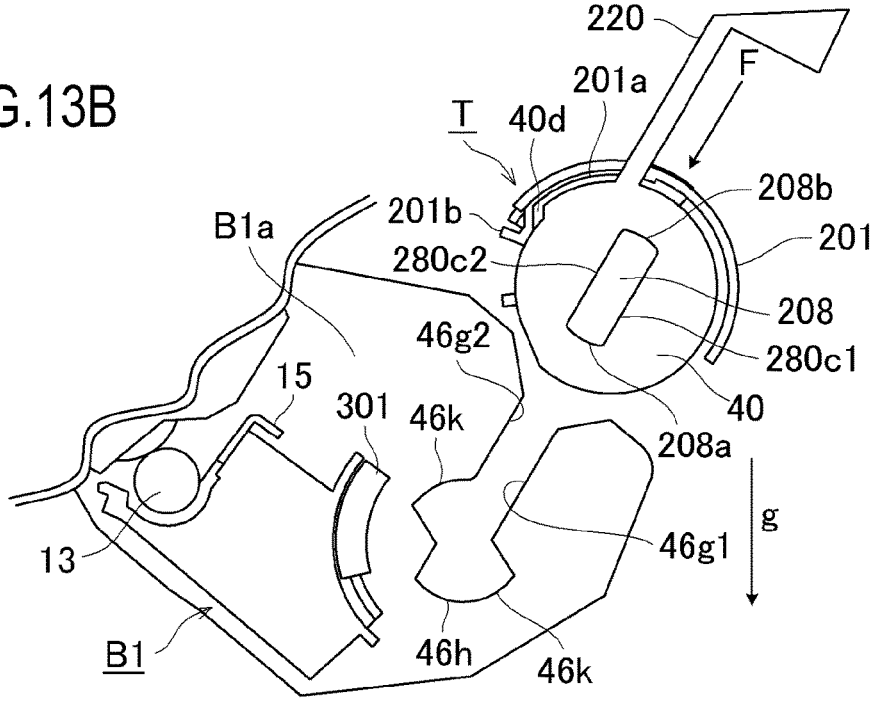
Figure 14:
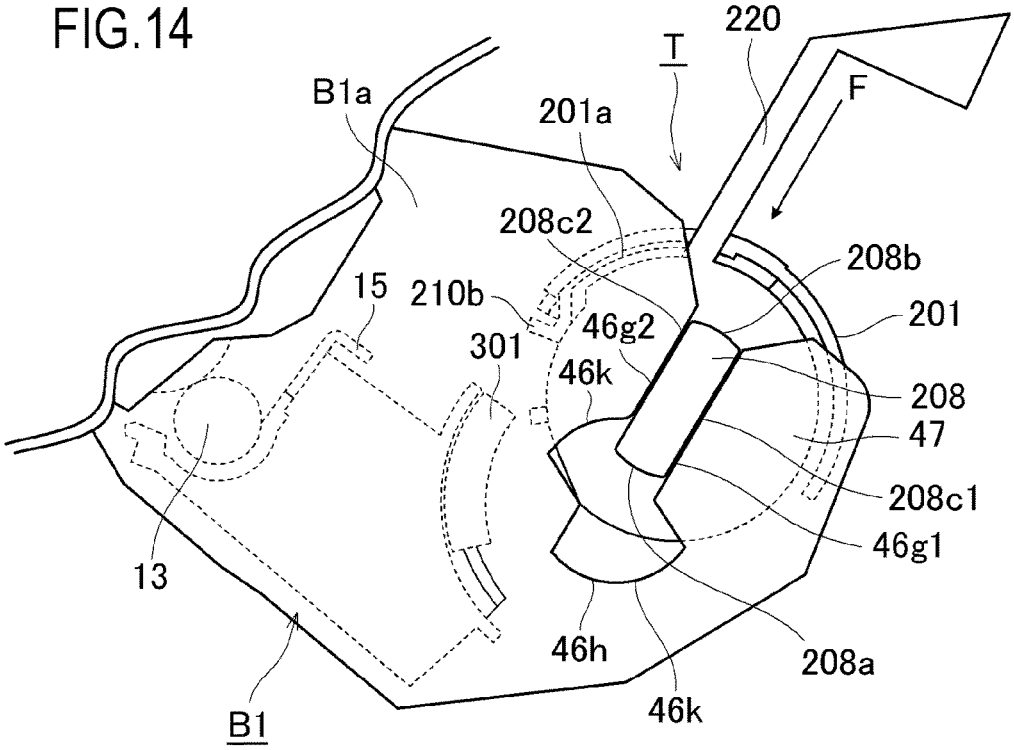
FIG. 14 is a side view showing a state in which the toner cartridge according to the embodiment is being inserted.
Figure 15A:
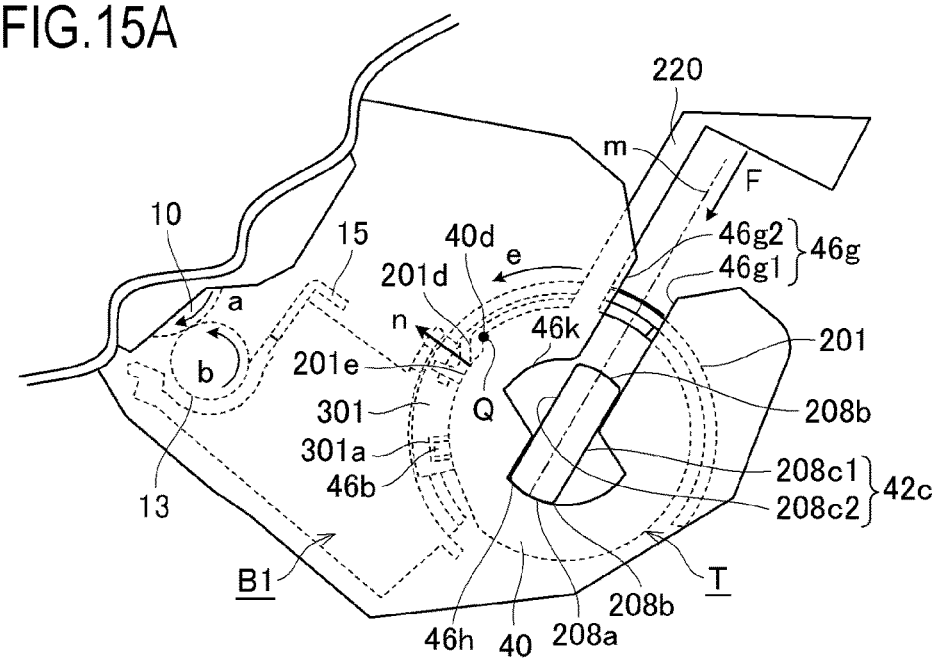
FIGS. 15A and 15B are side views showing a state in which the insertion of the toner cartridge according to the embodiment is completed.
Figure 15B:
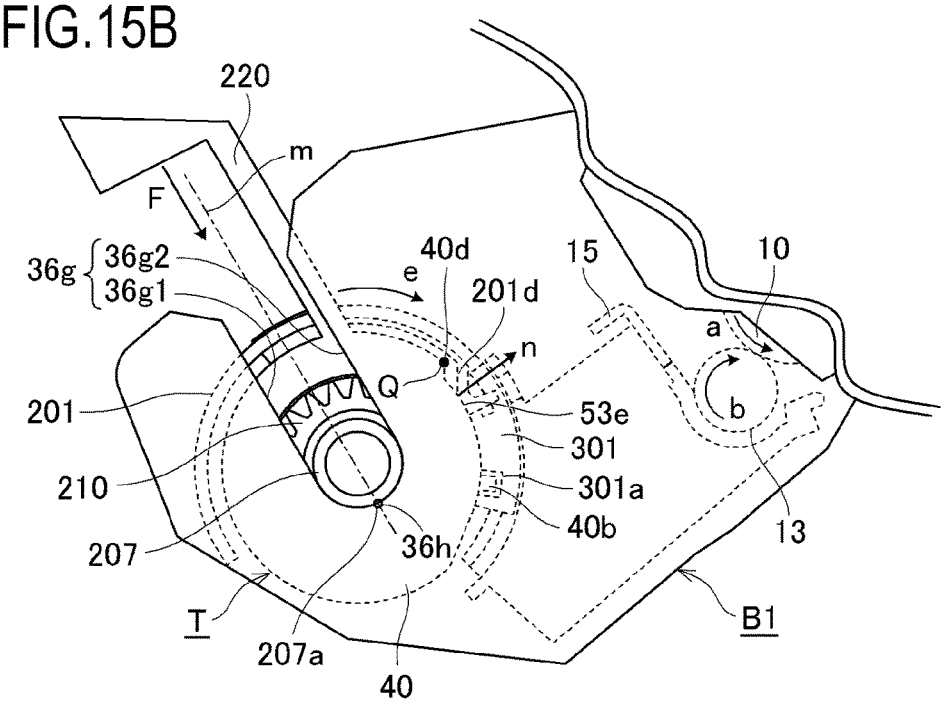

A description will be given, with reference to FIGS. 13A and 13B to FIGS. 15A and 15B, of the operation of inserting the toner cartridge T into the process cartridge P. FIG. 13A is a perspective explanatory view showing a state in which the toner cartridge T is inserted into the process cartridge P. FIG. 13B is a side view showing the state in which the toner cartridge T is inserted. FIG. 14 is a side view showing a state in which the toner cartridge T is being inserted. FIG. 15A is a side view of the toner cartridge T showing the positional relationship between the second grip 220 and the abutment portion 208*a* in an attachment direction. FIG. 15B is a side view of the toner cartridge T showing the positional relationship between the second grip 220 and the abutment portion 207*a* in the attachment direction.

When the toner cartridge T is attached to the toner cartridge accommodation portion B1*a* of the process cartridge P, the reception opening portion 16*d* of the developing unit B1 and the supply opening portion 200 of the toner cartridge T are in a closed state. That is, the developing shutter 301 and the toner shutter 201 are placed at positions at which the reception opening portion 16*d* and the supply opening portion 200 are closed, respectively. Further, the toner cartridge T is inserted into the process cartridge P in a direction (F-direction in FIG. 13B) in which the abutment portion 208*a* is on the downstream side of the inserted guide portion 208 along the restriction portions 208*c*1 and 208*c*2 when seen from the lateral surface in the longitudinal direction of the toner cartridge T.

As shown in FIG. 13A, the user grips the second grip 220 and moves the toner cartridge T into the process cartridge P in the inserting direction F. At this time, the user moves the toner cartridge T so that the inserted guide portion 208 of the toner cartridge T and the insertion guide 46*g* of the developing unit B1 engage with each other and the positioning boss 207 serving as an inserted guide portion and the insertion guide 36*g* engage with each other. At this time, the toner cartridge T is inserted so that the restriction portions 208*c*1 and 208*c*2 of the inserted guide portion 208 and guide surfaces 46*g*1 and 46*g*2 of the insertion guide 46*g* are fitted with each other, respectively, in the direction of gravity g (FIG. 13B). Similarly, the positioning boss 207 serving as an inserted guide portion is also inserted to be fitted with guide surfaces 36*g*1 and 36*g*2 in the direction of the gravity g. As a result, the restriction portion 208*c*1 and the guide surface 46*g*1 contact each other and the positioning boss 207 serving as an inserted guide portion and the guide surface 36*g*1 contact each other in the direction of the gravity g. Thus, as shown in FIG. 14, the attitude of the toner cartridge T with respect to the developing unit B1 is fixed. Then, the user further moves the toner cartridge T downward in the direction of the gravity g along the insertion guides 46*g* and 36*g* in the attitude to be inserted into the developing unit B1 along the direction of the arrow F. Then, when the user moves the toner cartridge T in the direction of the arrow F along the insertion guides 46*g* and 36*g*, the abutment portions 208*a* and 207*a* abut against the abutted portions 46*h* and 36*h*, respectively. In the manner described above, the insertion of the toner cartridge T into the toner cartridge accommodation portion B1*a* of the process cartridge P is completed (as shown in FIGS. 15A and 15B). As will be described in detail later, the reception opening portion 16*d* and the supply opening portion 200 are in a closed state at this time, and the attachment position of the toner cartridge T with respect to the process cartridge P at this time is a second attachment position at which the movement of the toner is restricted.

Positioning of Toner Cartridge T with Respect to Process Cartridge P

Figure 16A:
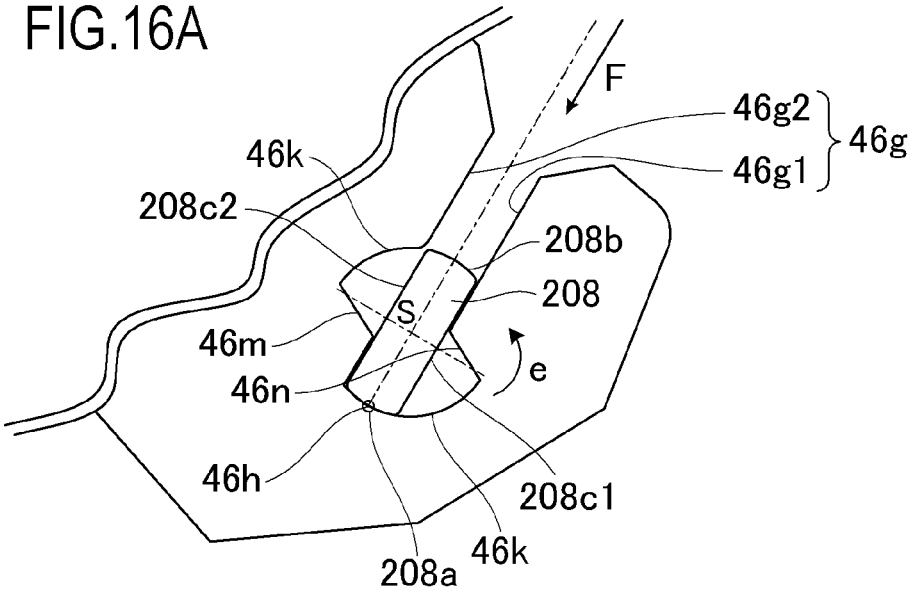
FIGS. 16A and 16B are explanatory views showing the state in which the insertion of the toner cartridge according to the embodiment is completed.
Figure 16B:
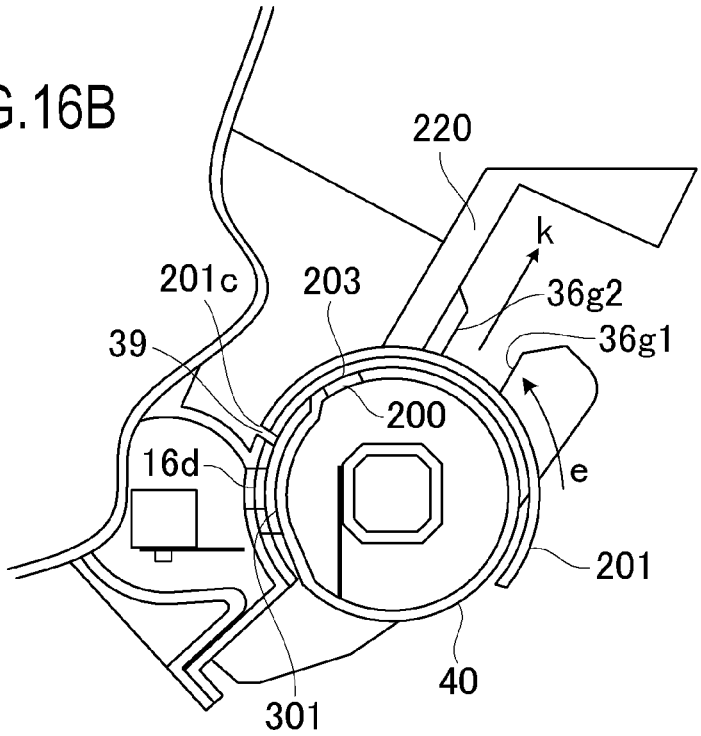
Figure 17A:
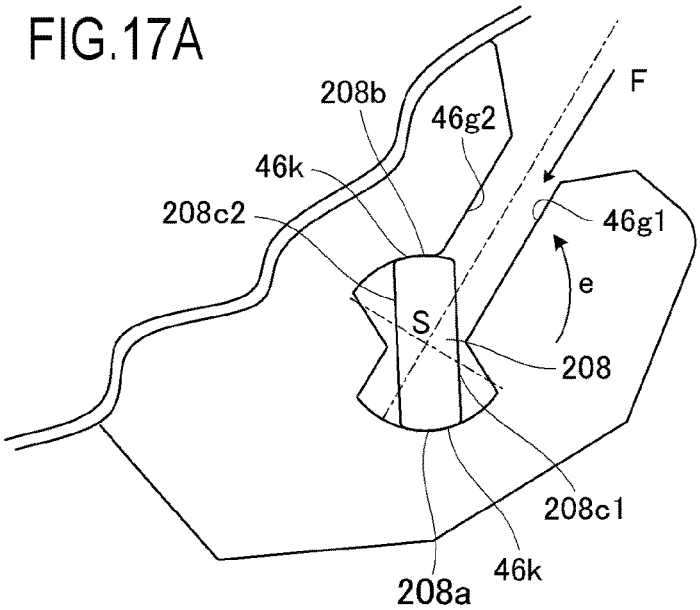
FIGS. 17A to 17C are explanatory views showing a state in which the toner cartridge according to the embodiment is being attached and rotated.
Figure 17B:
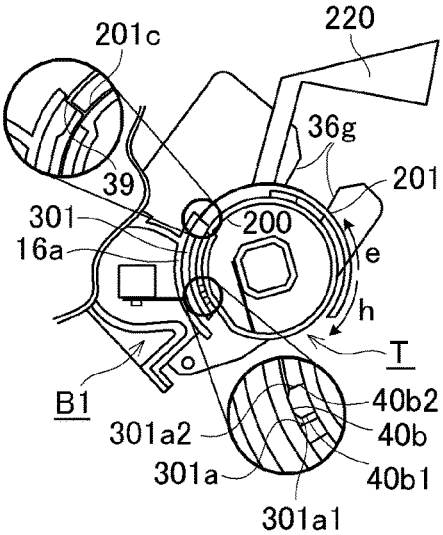
Figure 17C:
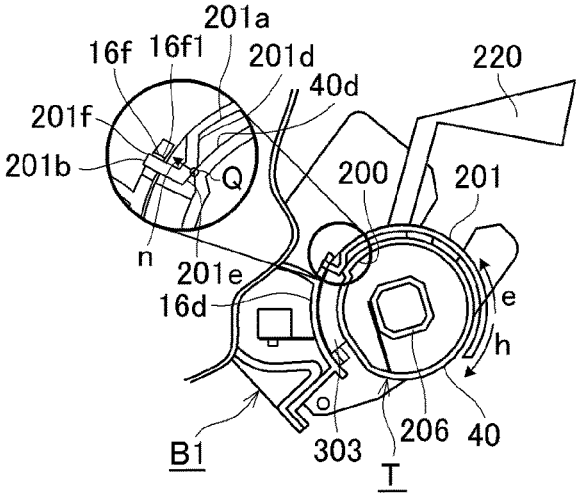

A description will be given, with reference to FIGS. 16A and 16B and FIGS. 17A to 17C, of the positioning of the toner cartridge T with respect to the process cartridge P. FIG. 16A is a side view showing the toner cartridge T in a state in which the abutment portion 208*a* abuts against the abutted portion 46*h*. FIG. 16B is a cross-sectional view showing the toner cartridge T in a state in which the abutment portion 208*a* abuts against the abutted portion 46*h*. FIG. 17A is a side view showing a state in which the toner cartridge T is positioned with respect to the process cartridge P. FIG. 17B is a cross-sectional view showing the engagement relationship between the positioned toner cartridge T and the process cartridge P. FIG. 17C is a cross-sectional view showing another engagement relationship between the positioned toner cartridge T and the process cartridge P.

The toner frame member 40 of the toner cartridge T inserted into the developing unit B1 is rotated by the second grip 220 in a counterclockwise direction (in the direction of an arrow e in FIGS. 16A and 16B) when seen in FIGS. 16A and 16B. Then, the opening/closing guided portion 208*b* of the toner cartridge T engages with the opening/closing guide portion 46*k* as shown in FIG. 17A, and the toner cartridge T is relatively positioned with respect to the process cartridge P.

Figure 18:
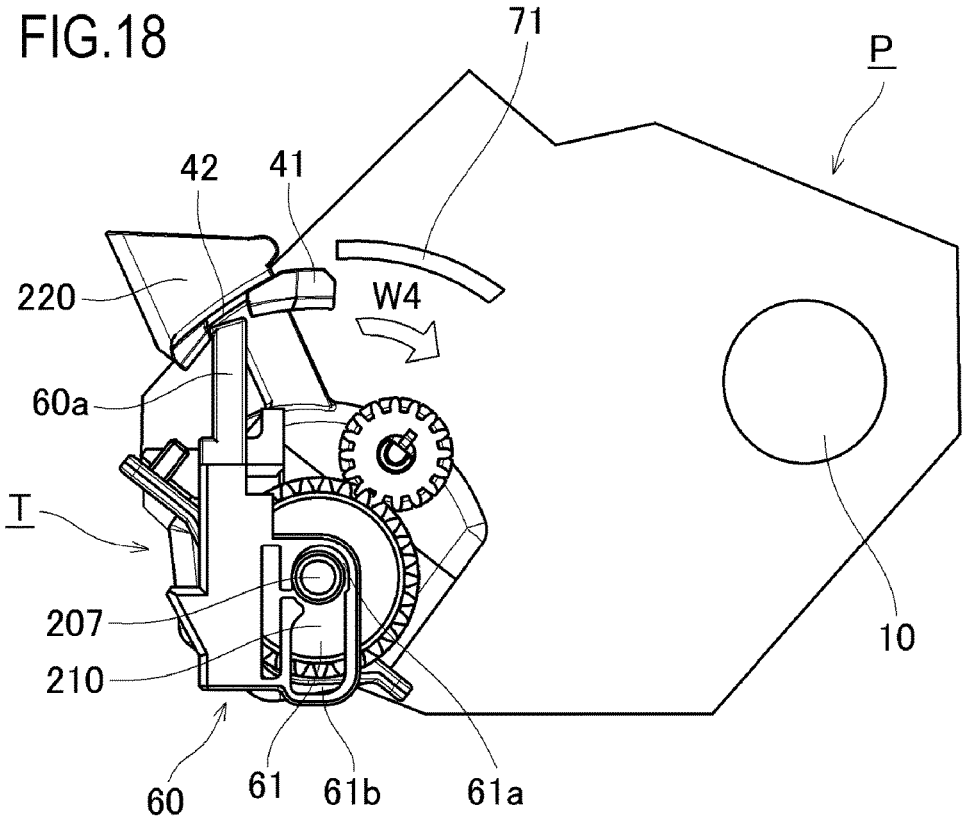
FIG. 18 is a side view for describing a method for rotating and attaching the toner cartridge according to the embodiment.
Figure 19:
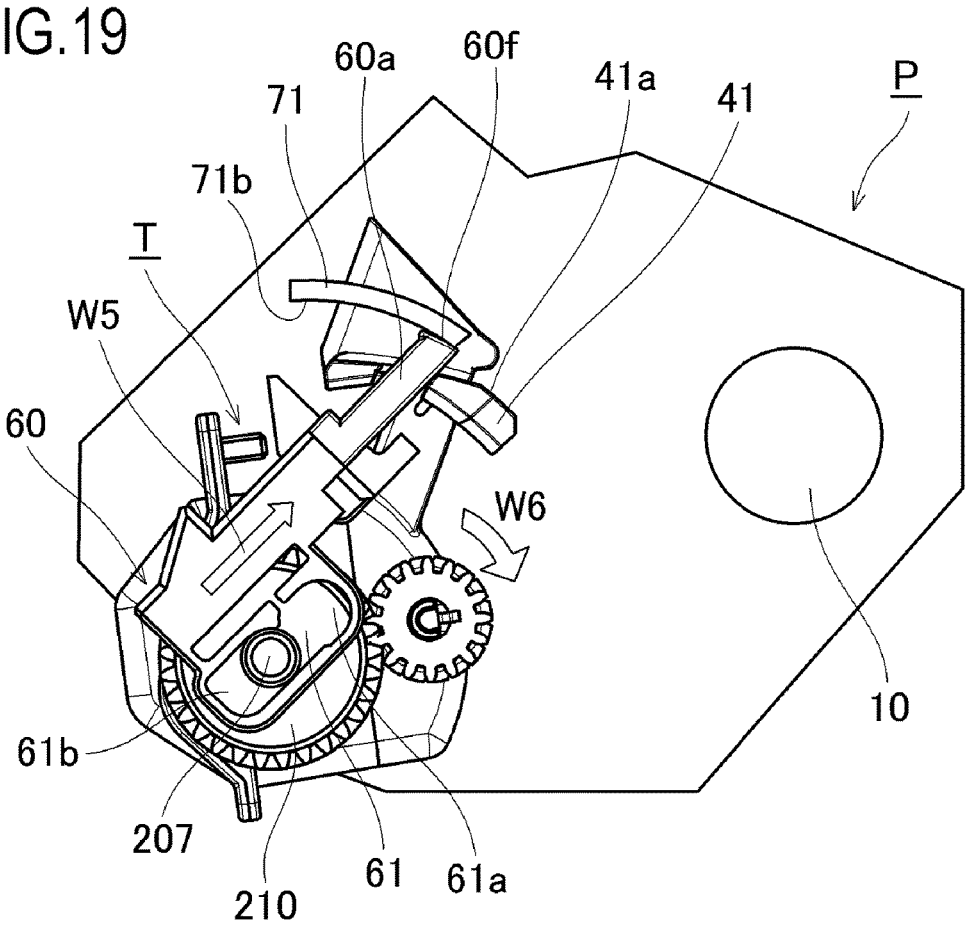
FIG. 19 is a side view for describing the method for rotating and attaching the toner cartridge according to the embodiment.

Method for Making Rotation Locking Member 60 and Process Cartridge P Engage with Each Other A description will be given, with reference to FIGS. 1A and 1B, FIG. 18, and FIG. 19, of a method for making the rotation locking member 60 and the process cartridge P engage with each other. FIG. 1A, FIG. 18, and FIG. 19 are side views of the driving side for describing a method for rotating and attaching the toner cartridge T with the rotation locking member 60 to the process cartridge P. FIG. 18 shows a state in which the insertion of the toner cartridge T into the process cartridge P is completed. In this state, the toner cartridge T is further rotated in the direction of an arrow W4 in FIG. 18 and attached to the process cartridge P.

In a cross section perpendicular to the axis of the photosensitive drum 10, the process cartridge P has an inwardly-protruding guide 71 having an arc-shaped cross section on its driving-side lateral surface (a perspective shape shown in FIGS. 8A, 8B, and 13A).

When the toner cartridge T is rotated and attached to the process cartridge P in the direction of the arrow W4 about the axis of the positioning boss 207 as shown in FIG. 18, the rib 41 provided on the toner cartridge T moves under the guide 71.

Since a lower surface 71*b* of the guide 71 has a substantially arc shape with the axis of the positioning boss 207 as a rotation center as shown in FIG. 19, the toner cartridge T may be rotated and attached to the process cartridge P with the rib 41 and the lower surface 71*b* facing each other when the toner cartridge T is rotated in the direction of an arrow W6 in FIG. 19. Accordingly, the operation of rotating and attaching the toner cartridge T to the process cartridge P by the user may be assisted.

Further, in rotating and attaching the toner cartridge T, the rotation locking member 60 is pressed in the direction of an arrow W5 in FIG. 19 to change the relative position of the rotation locking member 60 with respect to the toner cartridge T. Thus, the pin tip end 60*f* of the bolt pin 60*a* is in abutment with the lower surface 71*b* of the guide 71. In this state, the operation of rotating and attaching the toner cartridge T to the process cartridge P is further continued in the direction of an arrow W6 in FIG. 19.

As shown in FIG. 1A, the relative position of the rotation locking member 60 with respect to the toner cartridge T is further changed, while the attachment and the rotation operation of relatively rotating the toner cartridge T with respect to the process cartridge P is further continued. Specifically, the rotation locking member 60 is displaced with respect to the toner cartridge T so that the protruded portion 60*b* formed on the bolt-pin upper surface 60*g* shown in FIG. 1B reaches a restriction surface 71*a* of the guide 71 and then further moves in the direction of an arrow W7 in FIG. 1A. By the relative displacement between the rotation locking member 60 and the toner cartridge T, the engagement position of the positioning hole 61 with respect to the positioning boss 207 moves from the (front) positioning hole 61*a* to the (rear) positioning hole 61*b*.

The bolt pin 60*a* also moves in the direction of the arrow W7 in FIG. 1A and protrudes from the guide 71. Then, when the toner cartridge T rotates in the direction of an arrow h in FIG. 1A, the bolt-pin upper surface 60*g* contacts the restriction surface 71*a* of the guide 71 to be capable of restricting the rotation of the toner cartridge T with respect to the process cartridge P. The relative position of the rotation locking member 60 with respect to the toner cartridge T and the process cartridge P at this time is a restricting position. In this state, the process cartridge P is attached to the image forming apparatus body A1 together with the toner cartridge T and the rotation locking member 60.

As described above, the bolt pin 60*a* has the protruded portion 60*b* on the bolt-pin upper surface 60*g* at its tip end. Thus, even if the toner cartridge T rotates in the direction of the arrow h in FIG. 1A and a force acts on the rotation locking member 60 in a direction opposite to the direction of the arrow W7 in FIG. 1A, the protruded portion 60*b* is held by the restriction surface 71*a* of the guide 71 in a snagged state so long as the force is light. Accordingly, even if slight vibration or an impact is added, the contacting state between the bolt-pin upper surface 60*g* and the restriction surface 71*a* of the guide 71 is held.

Opening Operations of Shutters

Figure 20A:
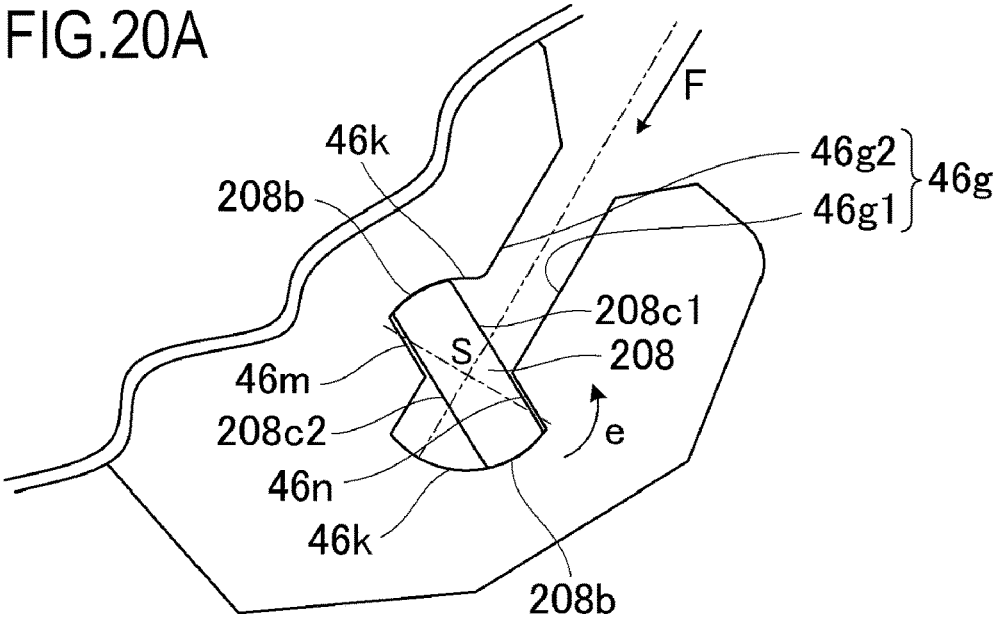
FIGS. 20A and 20B are explanatory views showing a state in which the attachment and the rotation of the toner cartridge according to the embodiment is completed.
Figure 20B:
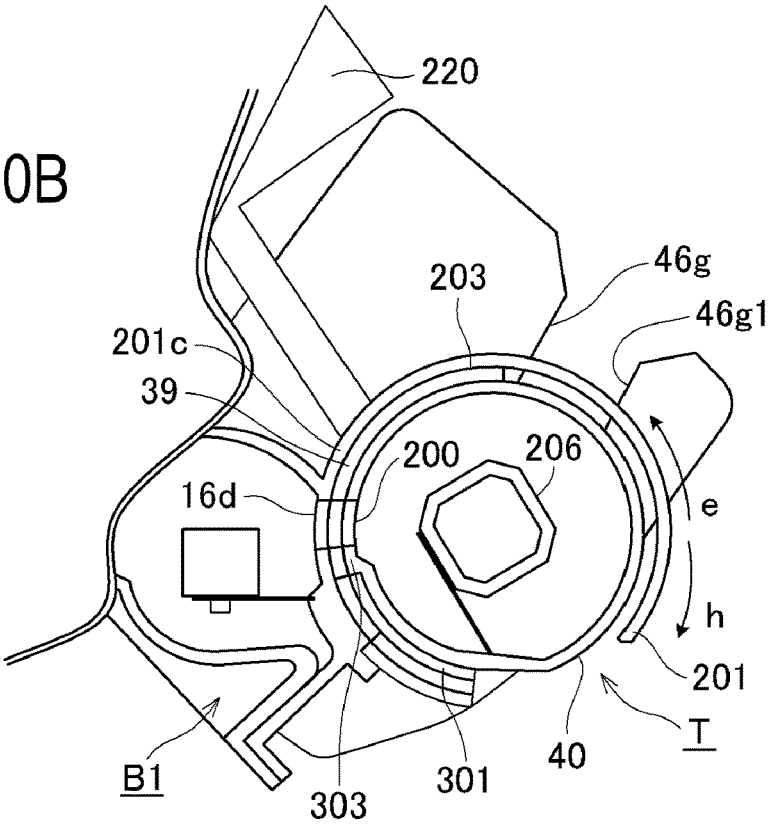

A description will be given, with reference to FIG. 15A, FIGS. 17A to 17C, and FIGS. 20A and 20B, of the opening operations of the developing shutter 301 of the developing unit B1 and the toner shutter 201 of the toner cartridge T. FIG. 20A is a side view showing a state in which the reception opening portion 16*d* and the supply opening portion 200 are opened. FIG. 20B is a cross-sectional view showing the state in which the reception opening portion 16*d* and the supply opening portion 200 are opened.

The toner cartridge T is positioned with respect to the process cartridge P as shown in FIG. 17A, and then rotated in the direction of an arrow e by the second grip 220. As a result, as shown in FIG. 17B, a tip end surface 201*c* (see FIG. 9B) of the toner shutter 201 abuts against a collision surface 39 (see FIG. 8B) of the developing unit B1. Thus, the rotation of the toner shutter 201 is restricted. Further, the protruded portions 40*b* of the toner frame member 40 engage with the hole portions 301*a* of the developing shutter 301. The rotation of the toner shutter 201 is restricted even if the toner shutter 201 is further rotated in this state. Therefore, the toner frame member 40 relatively moves with respect to the toner shutter 201 in a direction in which the supply opening portion 200 is opened. At this time, surfaces 40*b*1 of the protruded portions 40*b* contact surfaces 301*a*1 of the hole portions 301*a*, and the developing shutter 301 is pressed against the protruded portions 40*b* of the toner frame member 40. As a result, the shutter 301 rotates simultaneously with the toner frame member 40, and the reception opening portion 16*d* is opened. In addition, as shown in FIGS. 15A and 17C, points Q of surfaces 40*d* that face the snap fit portions 201*a* of the toner shutter 201 of the outer peripheral surface of the toner frame member 40 move along surfaces 201*d* of the snap fit portions 201*a* and contact surfaces 201*e*. At this time, the snap fit portions 201*a* deform so that the surfaces 201*e* receive a force in the direction of an arrow n from the points Q to be displaced in the direction of the arrow n. Then, the claw portions 201*b* engage with the hole portions 16*f* of the developing unit B1 as the developing shutter 301 rotates.

After that, the opening of the reception opening portion 16*d* and the supply opening portion 200 is completed in a state in which the supply opening portion 200 and the reception opening portion 16*d* communicate with each other as shown in FIG. 20B. At this time, as shown in FIG. 20A, the restriction portions 208*c*2 and 208*c*1 contact restricted portions 46*m* and 46*n*, respectively, and the toner cartridge T is relatively positioned with respect to the process cartridge P in its rotating direction as well as its inserting direction.

Here, the toner cartridge T is prevented from rotating in the direction of the arrow e from the state shown in FIG. 20A with respect to the process cartridge P. In other words, as shown in FIG. 1A, the toner cartridge T is prevented from rotating in the direction of the arrow e with respect to the process cartridge P.

Further, as shown in FIG. 1A, the bolt-pin upper surface 60*g* contacts the restriction surface 71*a* of the guide 71 when the toner cartridge T attempts to rotate in the direction of the arrow h. Accordingly, the toner cartridge T is allowed to rotate with respect to the process cartridge P by play required to attach respective portions but prevented from rotating in the direction of the arrow h in FIG. 1A by the play or more.

Accordingly, in this state, the rotation of the toner cartridge T in both directions of the arrow h and the arrow e in FIG. 1A with respect to the process cartridge P is restricted.

Thus, the toner cartridge T may be prevented from rotating with respect to the process cartridge P due to vibration or an impact generated during its transport.

In addition, at this time, the second driving transmission member 211 is coupled to the first driving transmission portion 38 of the developing unit B1, whereby the transmission of the driving from the process cartridge P to the toner transport member 206 is allowed.

As a result, the circulation of the toner t2 between the toner frame member 40 of the toner cartridge T and the developer accommodation portion 16*a* of the developing unit B1 is made possible (see FIG. 3). The attachment position of the toner cartridge T with respect to the process cartridge P at this time is a first attachment position at which the movement of the toner is allowed.

Method for Disengaging Toner Cartridge T from Process Cartridge P

Figure 21B:
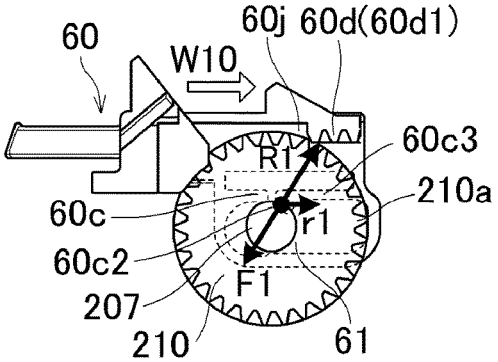
Figure 21C:
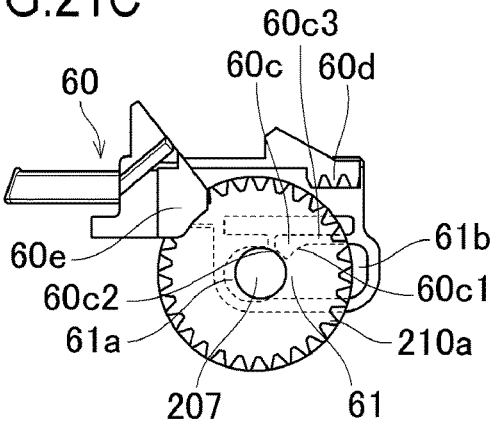

A description will be given, with reference to FIGS. 21A to 21C, of a method for disengaging the toner cartridge T with the rotation locking member 60 from the process cartridge P. FIGS. 21A to 21C are schematic cross-sectional views (side views) obtained when the gear tooth plane portion on the driving side shown in FIG. 11 is cut off in the direction orthogonal to the longitudinal direction, wherein the cartridge is seen from the inside in the longitudinal direction. The operation of disengaging the rotation locking member 60 is performed in the order of FIG. 21A, FIG. 21B, and FIG. 21C.

Like FIG. 1A, FIG. 21A shows a state in which a cartridge packaged body (the image forming apparatus in which the process cartridge P with the rotation locking member 60 and the toner cartridge T are attached to the apparatus body) is delivered to the user. In this state, the bolt pin 60*a* protrudes from the guide 71, and the bolt-pin upper surface 60*g* contacts the restriction surface 71*a* of the guide 71. Therefore, the rotation of the toner cartridge T with respect to the process cartridge P is restricted. The relative position of the rotation locking member 60 with respect to the toner cartridge T and the process cartridge P at this time is a restricting position. When the body with the process cartridge P and the toner cartridge T is delivered to the user, the user inputs power to the body to start printing. When the power is input to the body, the body performs an initial sequence and inputs driving to the cartridge. The driving input from the body is transmitted to the toner transport driving transmission member 210 via the second driving transmission member 211, and the toner transport driving transmission member 210 rotates in the direction of an arrow W8 in FIG. 21A.

As shown in FIG. 21A, the rotation locking member 60 has the rack 60*d*. In a state in which the assembling of the rotation locking member 60 is completed, the rack 60*d* meshes with the gear portion 210*a* of the toner transport driving transmission member 210. By the mesh between the gear portion 210*a* and the rack 60*d*, the rotation locking member 60 moves in the direction of the arrow W9 in FIG. 21A together with the bolt pin 60*a*.

The rack 60*d* of the rotation locking member 60 has three teeth as a tooth portion 60*d*1 and a tooth-free portion 60*j* in the direction of an arrow W10 in FIG. 21B. Accordingly, as shown in FIG. 21B, when the rotation of the toner transport driving transmission member 210 is continued, there is a timing at which the mesh between the gear portion 210*a* of the toner transport driving transmission member 210 and the rack 60*d* is released. The gear portion 210*a* does not contact to the tooth-free portion 60*j*.

As shown in FIGS. 1A and 21A, the rotation locking member 60 has the snap fit portion 60*c* described above. The snap fit portion 60*c* is composed of the arm 60*c*3, the inclination portion 60*c*1, and the pressing portion 60*c*2.

As shown in FIG. 21B, the arm 60*c*3 of the snap fit portion 60*c* elastically deforms and contacts the pressing portion 60*c*2 at the timing at which the mesh between the gear portion 210*a* of the toner transport driving transmission member 210 and the rack 60*d* is released. Thus, a force F1 generated by the elastic deformation of the snap fit portion 60*c* is applied to the positioning boss 207. By a component force r1 generated from a reaction force R1 of the force F1, the rotation locking member 60 further moves in the direction of the arrow W10 in FIG. 21B to be put in the state of FIG. 21C. That is, an urging force for urging the positioning hole 61 of the rotation locking member 60 to change its engagement position with respect to the positioning boss 207 is applied from the snap fit portion 60*c* serving as urging means to the positioning boss 207.

Then, as shown in FIG. 21C, the bending of the arm 60*c*3 of the snap fit portion 60*c* is restored, and the cylindrical positioning boss 207 is arranged between the arc shape of the (front) positioning hole 61*a* of the positioning hole 61 and the pressing portion 60*c*2. Accordingly, the rotation locking member 60 moves so that the engagement portion of the positioning boss 207 moves from the (rear) positioning hole 61*b* to the (front) positioning hole 61*a* in the transition of states from FIG. 21A to FIG. 21C. The relative position of the rotation locking member 60 with respect to the toner cartridge T and the process cartridge P at this time is a non-restricting position.

Further, when the engagement portion of the positioning boss 207 moves from the (front) positioning hole 61*a* to the (rear) positioning hole 61*b*, the pressing portion 60*c*2 of the snap fit portion 60*c* contacts the engagement portion. Accordingly, the positioning boss 207 is prevented from being restored from the state shown in FIG. 21C to the state shown in FIG. 21B or the state shown in FIG. 21A. That is, when the positioning boss 207 and the snap fit portion 60*c* contact each other, the urging force for urging the positioning hole 61 of the rotation locking member 60 to change the engagement position with respect to the positioning boss 207 is applied from the snap fit portion 60*c* to the positioning boss 207.

Further, FIG. 21C shows a state at image formation (a state in which an image forming operation is allowed). Even at the image formation, the gear portion 210*a* of the toner transport driving transmission member 210 is prevented from contacting the rack 60*d*. Accordingly, vibration or the like due to the tooth contact between the gear portion 210*a* and the rack 60*d* does not occur, and an image failure such as banding does not occur.

Operation of Closing Shutters

A description will be given, with reference to FIGS. 16A and 16B and FIGS. 17B and 17C, of the operation of closing the developing shutter 301 of the developing unit B1 and the toner shutter 201 of the toner cartridge T.

First, in a state shown in FIG. 17B, the user grips the second grip 220 and rotates the toner frame member 40 in a closing direction (in the direction of the arrow h). Then, as shown in FIG. 17B, surfaces 40*b*2 of the protruded portions 40*b* of the toner frame member 40 abut against surfaces 301*a*2 of the hole portions 301*a* of the developing shutter 301. As a result, the developing shutter 301 rotates simultaneously with the toner frame member 40 with the reception of a force from the surfaces 301*a*2 and closes the reception opening portion 16*d*. In addition, as shown in FIG. 17C, the claw portions 201*b* of the toner shutter 201 engage with the hole portions 16*f* of the developing unit B1 at this time. Therefore, the surfaces 201*f* of the claw portions 201*b* abut against the surfaces 16*f*1 of the hole portions 16*f*, and the toner shutter 201 does not move with the toner frame member 40. Accordingly, the toner frame member 40 relatively moves with respect to the toner shutter 201, and the supply opening portion 200 is also closed.

Then, when the toner cartridge T is further rotated in the closing direction (in the direction of the arrow h), the positioning of the toner cartridge T with respect to the process cartridge P is released as shown in FIGS. 16A and 16B. As a result, the extraction of the toner cartridge T in the direction of an arrow k in FIG. 16B is allowed.

(9) Description of Configuration of Attaching/Detaching Process Cartridge P to/from Image Forming Apparatus Body A1

Figure 22:
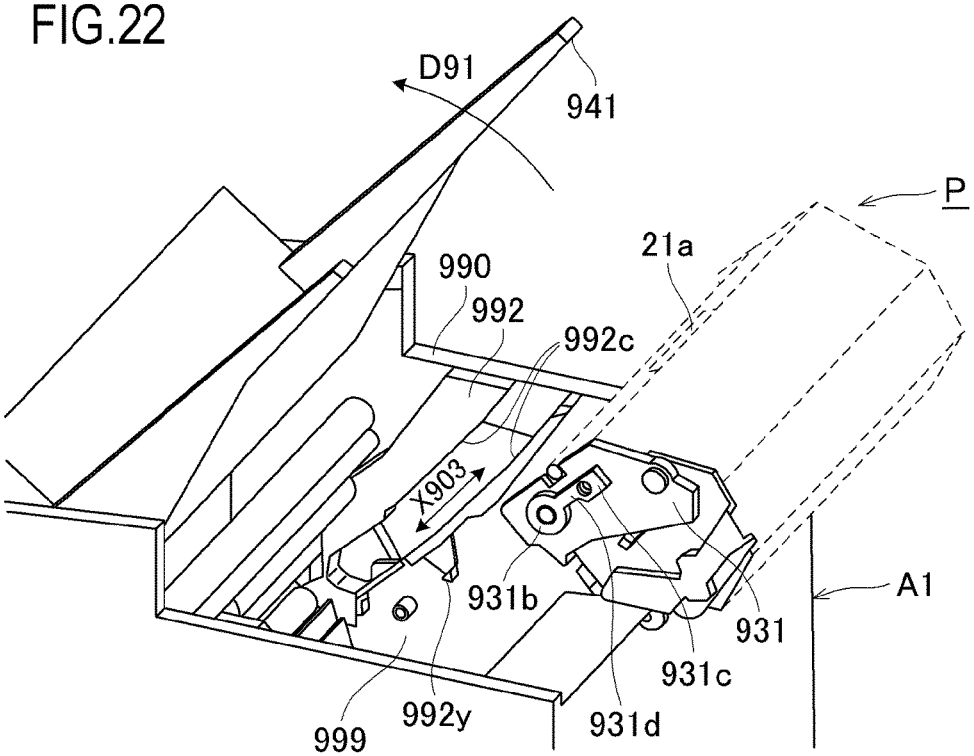
FIG. 22 is a driving-side perspective view showing the step of attaching the process cartridge according to the embodiment.
Figure 23:
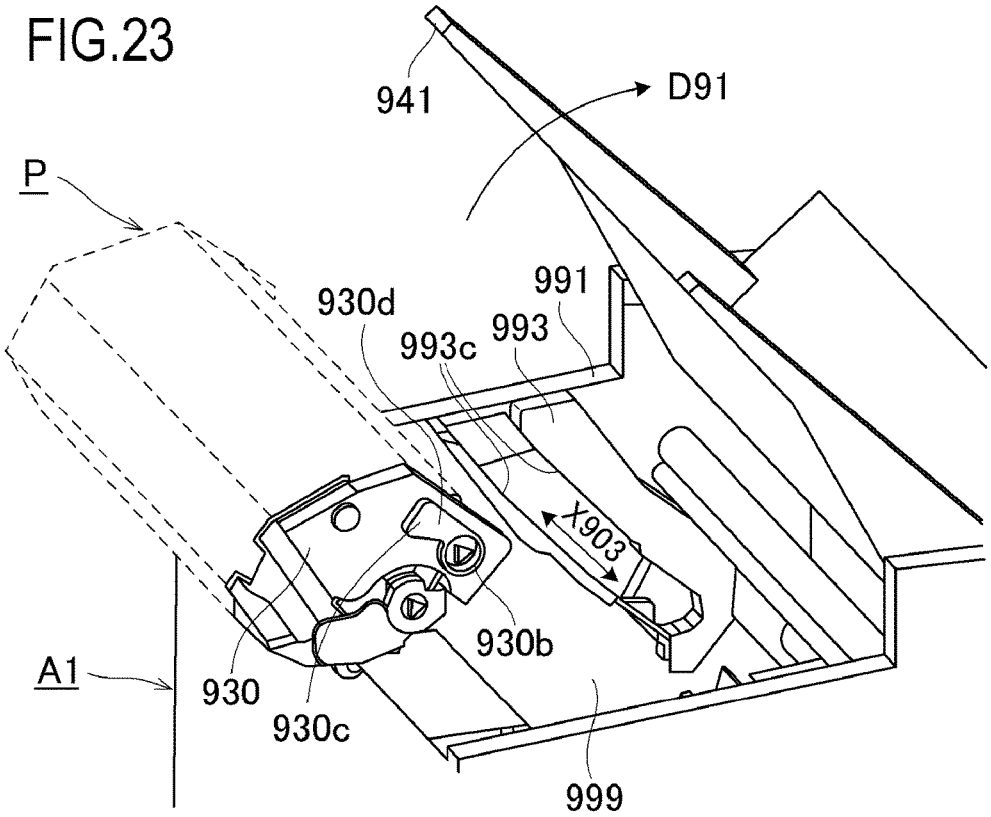
FIG. 23 is a non-driving side perspective view showing the step of attaching the process cartridge according to the embodiment.
Figure 24:
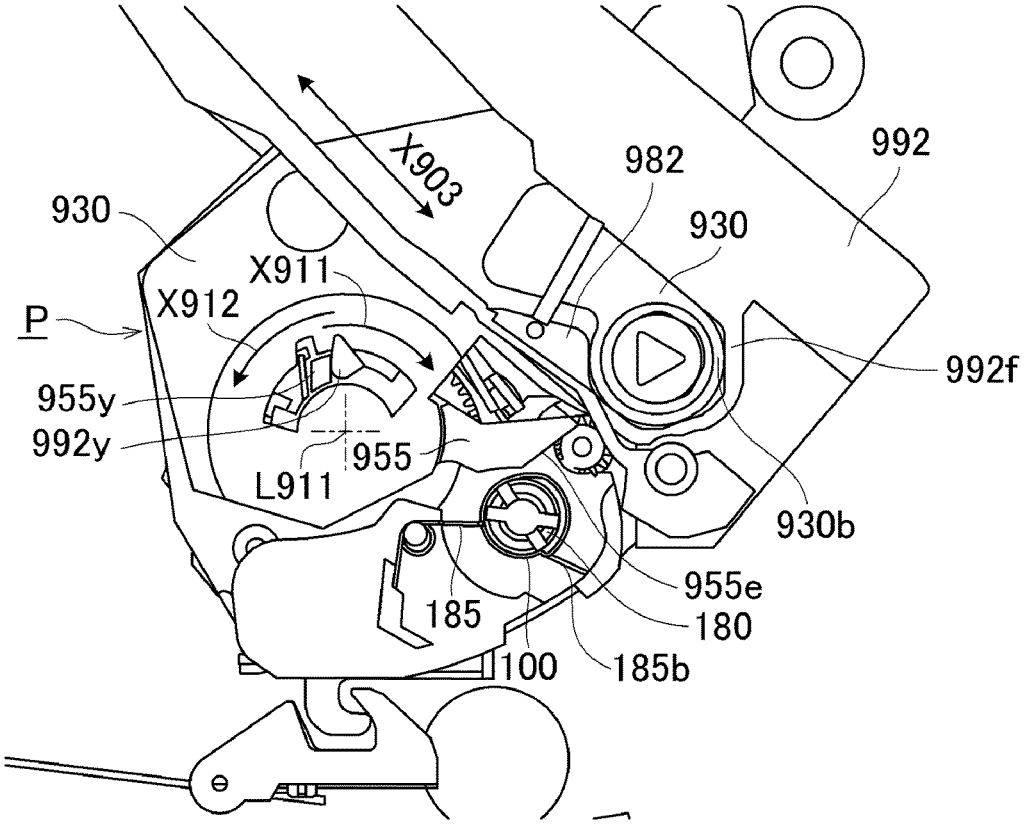
FIG. 24 is a lateral cross-sectional view showing a state in which the attachment of the process cartridge according to the embodiment is completed.
Figure 25:
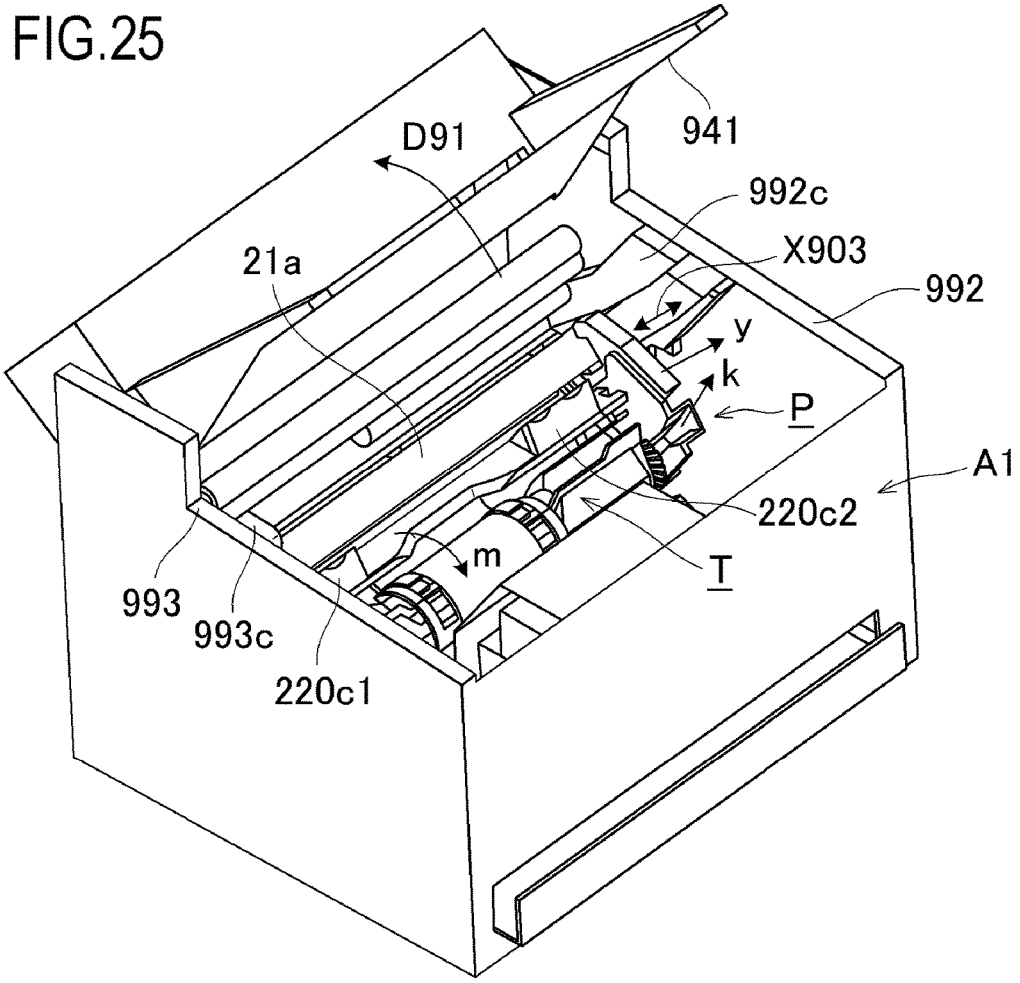
FIG. 25 is a perspective view showing the state in which the attachment of the process cartridge according to the embodiment is completed.

A description will be given, with reference to FIGS. 22 to 24, of a method for attaching/detaching the process cartridge P to/from the image forming apparatus body A1. FIG. 22 is a perspective explanatory view of the image forming apparatus body A1 when seen from the non-driving side. FIG. 23 is a perspective explanatory view of the image forming apparatus body A1 when seen from the driving side. FIG. 24 is an explanatory view showing a state in which the attachment of the process cartridge P to the image forming apparatus body A1 is completed. FIG. 25 is a perspective explanatory view showing the state in which the attachment of the process cartridge P to the image forming apparatus body A1 is completed.

As shown in FIG. 22, the process cartridge P has a non-driving drum bearing 931 on the non-driving side. Further, the non-driving drum bearing 931 has a guided portion 931*d*. The guided portion 931*d* has a positioning portion 931*b* and a rotation stop portion 931*c*.

Further, as shown in FIG. 23, a driving drum bearing 930 has a guided portion 930*d*. The guided portion 930*d* has a positioning portion 930*b* and a rotation stop portion 930*c*.

Meanwhile, as shown in FIGS. 22 and 23, a cartridge attachment portion 999 is provided inside a body cover 941 of the image forming apparatus body A1. On the driving side, a driving-side lateral plate 990 constituting the housing of the image forming apparatus body A1 is provided. Further, the driving-side lateral plate 990 has a driving-side guide member 992. In addition, a non-driving side lateral plate 991 has a non-driving side guide member 993. The driving-side guide member 992 has a guide portion 992*c*, and the non-driving side guide member 993 has a guide portion 993*c*. Further, the guide portion 992*c* of the driving-side guide member 992 and the guide portion 993*c* of the non-driving side guide member 993 have a groove shape along an attachment/detachment path X903 for the process cartridge P. Moreover, the driving-side guide member 992 has an abutment portion 992*y* that contacts a rotation restriction portion 955*e* of a coupling lever 955 (see FIG. 24) in the attachment process of the process cartridge P.

Attachment of Process Cartridge P to Image Forming Apparatus Body A1

As shown in FIGS. 22 and 23, the openable/closable body cover 941 arranged at the upper portion of the image forming apparatus body A1 is rotated in an opening direction (the direction of an arrow D91). Thus, the cartridge attachment portion 999 inside the image forming apparatus body A1 is exposed.

Then, while gripping the first grip 21*a* of the process cartridge P, the user makes the guided portions of the respective driving drum bearings at both ends of the process cartridge P engage the guide portions of the respective driving-side guide members of the image forming apparatus body A1. That is, the user makes the guided portion 931*d* (FIG. 22) of the non-driving drum bearing 931 engage the guide portion 993*c* (FIG. 23) of the non-driving side guide member 993, and makes the guided portion 930*d* (FIG. 23) of the driving drum bearing 930 engage the guide portion 992*c* (FIG. 22) of the driving-side guide member 992. Thus, the process cartridge P is inserted into the image forming apparatus body A1 along the attachment/detachment path X903 formed at the guide portion 992*c* of the driving-side guide member 992 and the guide portion 993*c* of the non-driving side guide member 993.

The positioning portion 930*b* of the driving drum bearing 930 receives an urging force from a driving-side pressing member 982. Thus, the positioning portion 930*b* contacts a positioning portion 992*f* provided at the driving-side guide member 992 (see FIG. 24). The non-driving side has the same configuration as that of the driving side, and the non-driving side of the process cartridge P is positioned and fixed to the non-driving side guide member 993. As a result, the driving drum bearing 930 of the process cartridge P is positioned and fixed to the driving-side guide member 992, and the non-driving drum bearing 931 of the process cartridge P is positioned and fixed to the non-driving side guide member 993 (see FIG. 24).

Extraction of Process Cartridge P from Image Forming Apparatus Body A1

As shown in FIG. 25, the openable/closable body cover 941 arranged at the upper portion of the image forming apparatus body A1 is rotated in the direction of the arrow D91. Thus, the process cartridge P and the toner cartridge T are exposed.

The user grips the first grip 21*a* of the process cartridge P and pulls the process cartridge P in the direction of an arrow y against an urging force from the driving-side pressing member 982 (FIG. 24) received by the positioning portion 930*b* of the driving-side drum bearing 930. Thus, the process cartridge P is separated from its positioning place along the attachment/detachment path X903 formed by the guide portion 992*c* of the driving-side guide member 992 and the guide portion 993*c* of the non-driving side guide member 993. When the user further pulls out the process cartridge P from the image forming apparatus body A1, the extraction of the process cartridge P is completed.

(10) Configuration of Attaching/Detaching Toner Cartridge T to/from Image Forming Apparatus Body A1

Figure 26A:
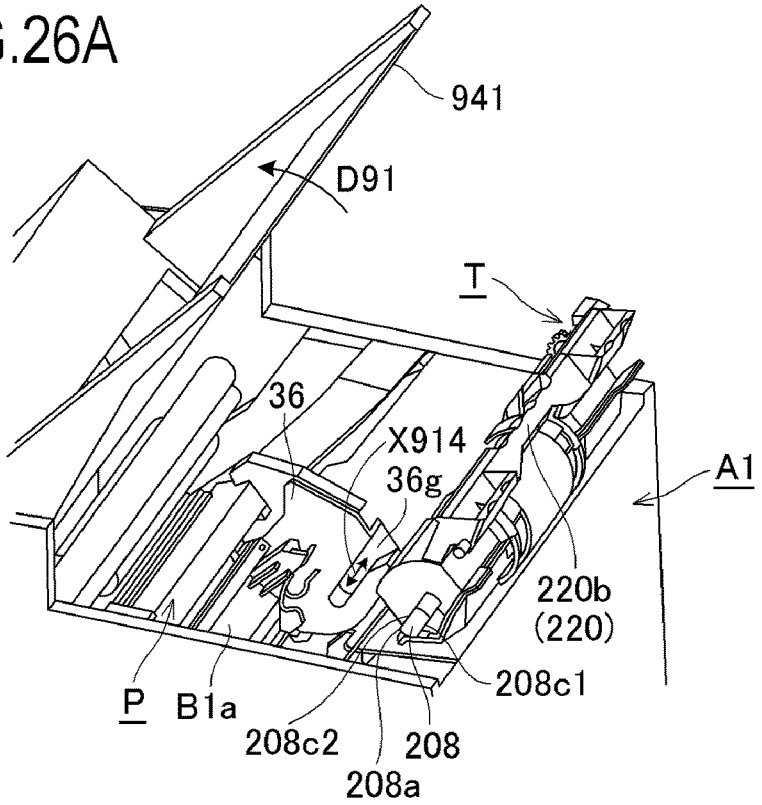
FIGS. 26A and 26B are perspective views showing the step of attaching the toner cartridge according to the embodiment.
Figure 26B:
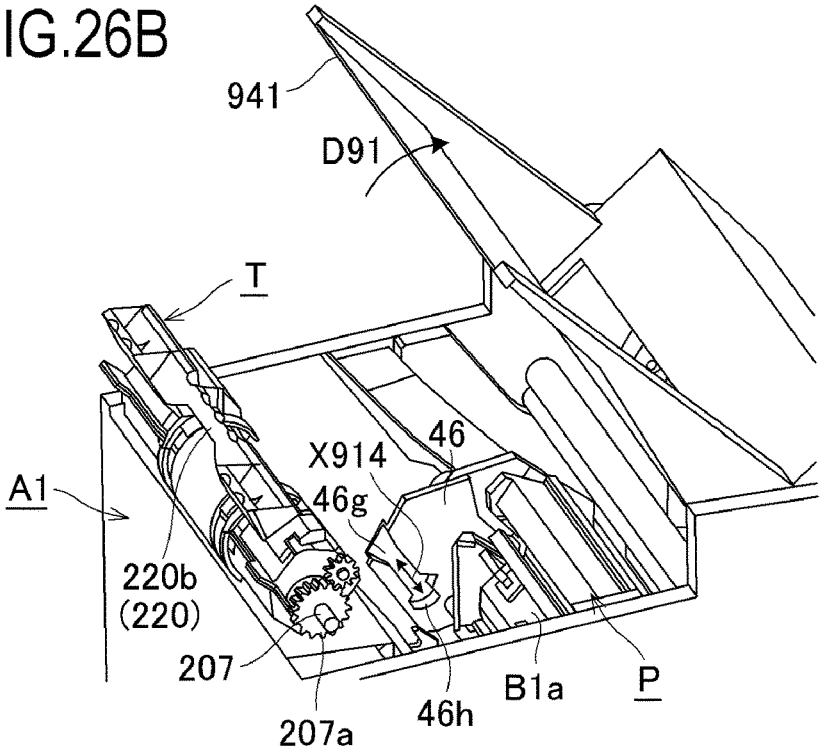

A description will be given, with reference to FIG. 16A, FIG. 17A, FIG. 25, and FIGS. 26A and 26B, of a method for attaching/detaching the toner cartridge T to/from the image forming apparatus body A1. FIG. 26A is a perspective explanatory view of the image forming apparatus body A1 when seen from the non-driving side in a state in which the process cartridge P is attached. FIG. 26B is a perspective explanatory view of the image forming apparatus body A1 when seen from the driving side in a state in which the process cartridge P is attached.

As shown in FIG. 26A, the toner cartridge T has the inserted guide portion 208 on the non-driving side. As described above, the inserted guide portion 208 has the restriction portions 208*c*1 and 208*c*2. Further, as shown in FIG. 26B, the toner cartridge T has the positioning boss 207 on the driving side. As described above, the positioning boss 207 has the abutment portion 207*a*.

On the other hand, as shown in FIG. 26A, the process cartridge P has the driving-side developing bearing 36 on the driving side. The driving-side developing bearing 36 has the insertion guide 36*g*. Further, as shown in FIG. 26B, the process cartridge P has the non-driving side developing bearing 46 on the non-driving side. As described above, the non-driving side developing bearing 46 has the insertion guide 46*g*. Further, the insertion guide 36*g* of the driving-side developing bearing 36 and the insertion guide 46*g* of the non-driving side developing bearing 46 have the groove shape along the attachment/detachment path X914 of the toner cartridge T.

Attachment of Toner Cartridge T to Image Forming Apparatus Body A1

As shown in FIGS. 26A and 26B, the openable/closable body cover 941 arranged at the upper portion of the image forming apparatus body A1 is rotated in the direction of the arrow D91. Thus, the inside of the image forming apparatus body A1 is exposed.

Then, while holding the first grip portion 220*b* of the second grip 220 of the toner cartridge T, the user makes the inserted guide 208 of the toner cartridge T engage the insertion guide 46*g* of the non-driving side developing bearing 46 of the process cartridge P. Further, the user makes the positioning boss 207 of the toner cartridge T engage the insertion guide 36*g* of the driving-side developing bearing 36 of the process cartridge P. Thus, the toner cartridge T is inserted into the image forming apparatus body A1 along the attachment path X914 formed by the insertion guide 46*g* of the non-driving side developing bearing 46 and the insertion guide 36*g* of the driving-side developing bearing 36. The toner cartridge T is inserted until the abutment portion 208*a* of the toner cartridge T abuts against the abutted portion 46*h* of the non-driving side developing bearing 46. Thus, the insertion of the toner cartridge T into the toner cartridge accommodation portion B1*a* of the process cartridge P inside the image forming apparatus body A1 is completed (FIG. 16A).

Extraction of Toner Cartridge T from Image Forming Apparatus Body A1

As shown in FIG. 25, the openable/closable body cover 941 arranged at the upper portion of the image forming apparatus body A1 is rotated in the direction of the arrow D91. Thus, the process cartridge P and the toner cartridge T are exposed.

The user grips the second grip portion 220*c*1 or the second grip portion 220*c*2 of the toner cartridge T and rotates the same in the direction of the arrow h shown in FIG. 20B. Then, the supply opening portion 200 of the toner cartridge T and the reception opening portion 16*d* of the process cartridge P shown in FIG. 20B are closed. When the toner cartridge T is rotated until the insertion of the process cartridge P is completed (see FIGS. 16A and 16B), the supply opening portion 200 of the toner cartridge T and the reception opening portion 16*d* of the process cartridge P are completely closed. Further, the user pulls the toner cartridge T in the direction of the arrow k shown in FIG. 16B. Thus, the toner cartridge T is separated from the toner cartridge accommodation portion B1*a* of the process cartridge P along the attachment path X914 formed by the insertion guide 36*g* of the driving-side developing bearing 36 and the insertion guide 46*g* of the non-driving side developing bearing 46 (see FIGS. 26A and 26B). The extraction of the toner cartridge T is completed when the user pulls out the toner cartridge T from the image forming apparatus body A1. When the extracted toner cartridge T is the first toner cartridge T, i.e., the toner cartridge T having been attached to the image forming apparatus body A1 together with the process cartridge P, the rotation locking member 60 is also simultaneously extracted from the image forming apparatus body A1.

As described above, the process cartridge P may be attached/detached to/from the image forming apparatus body A1 by the first grip 21*a* of the process cartridge P of the embodiment in a state of being combined with the toner cartridge T. Further, only the toner cartridge T may be attached/detached by the second grip 220 of the toner cartridge T in a state in which the process cartridge P remains in the image forming apparatus body A1.

According to the embodiment, the toner cartridge T may be maintained at its regular attachment position with respect to the process cartridge P in a state of being attached to and packaged in the body until the product is delivered to the user.

Further, once the toner cartridge T is used, the locking of the toner cartridge T with respect to the process cartridge P may be released with a simple configuration that does not place a burden on the user in preparation for the additional replacement of the toner cartridge T. Thus, the user may perform a replacement operation for a new toner cartridge T at all times after the start of using the body.

That is, according to the embodiment, the rotation of the toner cartridge T with respect to the process cartridge P may be restricted only at the transport of the toner cartridge T with the above simple configuration. Thus, it becomes possible to prevent trouble due to the deviation of the toner cartridge T during the transport and easily replace the toner cartridge T when the toner cartridge T is used up.

The effect is not limited to the rotation and the movement of the toner cartridge T with respect to the process cartridge P as described in the embodiment. For example, the effect may also be produced in a configuration in which the toner cartridge T does not rotate but relatively moves (such as linear movement) with respect to the process cartridge P. The same effect as that of the embodiment may be obtained when a rotation locking member having the same function as that of the rotation locking member 60 is applied to the configuration.

Further, the process cartridge P in the embodiment may be unitized processing means (process unit) that functions as a process cartridge and constituted as a part of the image forming apparatus body A1.

Further, the embodiment describes an example in which the toner cartridge T has the restriction member, but the process cartridge P may have the restriction member instead.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-040723, filed on Mar. 3, 2017, which is hereby incorporated by reference herein in its entirety.

What is claimed is:

1. A cartridge detachably attachable to an apparatus body of an image forming apparatus, the cartridge comprising:

a toner cartridge that accommodates toner;

a process cartridge that has an attachment portion to which the toner cartridge is detachably attached;

a restriction member provided on the toner cartridge, the restriction member being movable between (i) a restriction position at which relative movement between the toner cartridge attached to the attachment portion of the process cartridge and the process cartridge is restricted by an engagement of the restriction member and the process cartridge, and (ii) a non-restriction position at which the relative movement between the toner cartridge and the process cartridge is not restricted; and a driving transmission unit for transmitting a driving force from the apparatus body to the toner cartridge by engaging with the apparatus body, wherein the restriction member has a driving force reception portion that is capable of receiving the driving force from the driving transmission unit by engaging with the driving transmission unit, and wherein the restriction member moves from the restriction position to the non-restriction position when the driving force reception portion receives the driving force from the driving transmission unit.

2. The cartridge according to claim 1, wherein the toner cartridge is configured to be movable between (i) a first attachment position at which movement of the toner from the toner cartridge to the process cartridge is allowed in a state, in which an attachment operation of the toner cartridge to the attachment portion is completed, and (ii) a second attachment position at which the movement of the toner from the toner cartridge to the process cartridge is restricted in a state, in which the attachment operation of the toner cartridge to the attachment portion is not completed, and wherein the restriction member is configured to be placed at the restriction position when the toner cartridge is placed at the first attachment position.

3. The cartridge according to claim 2, wherein the cartridge is attached to the apparatus body in a state in which the toner cartridge is placed at the first attachment position and the restriction member is placed at the restriction position.

4. The cartridge according to claim 2, wherein the process cartridge becomes capable of performing an image forming operation after the restriction member moves from the restriction position to the non-restriction position upon receiving the driving force from the driving transmission unit through the driving force reception portion while the cartridge remains at the first attachment position.

5. The cartridge according to claim 1, wherein the toner cartridge is capable of being separated from the process cartridge together with the restriction member and extracted to outside the apparatus body while the process cartridge remains attached to the apparatus body.

6. The cartridge according to claim 1, wherein the driving transmission unit is a gear, wherein the driving force reception portion is a rack that meshes with the gear, and wherein the restriction member receives the driving force from the apparatus body when the gear and the rack mesh with each other.

7. The cartridge according to claim 1, wherein the toner cartridge has a positioning portion for positioning the restriction member by engaging with the restriction member, and an engagement position of the positioning portion with the restriction member is changed in accordance with a relative position of the restriction member with respect to the toner cartridge, and wherein the restriction member has an urging unit that applies to the positioning portion an urging force for restricting a change in an engagement position of the restriction member with the positioning portion after the restriction member moves from the restriction position to the non-restriction position.

8. The cartridge according to claim 7, wherein the urging unit applies to the positioning portion an urging force for urging the positioning portion to change the engagement position when the restriction member moves from the restriction position to the non-restriction position.

9. An image forming apparatus comprising:

an apparatus body; and the cartridge according to claim 1.

10. An image forming apparatus comprising:

an apparatus body;

a toner cartridge that accommodates toner and is detachably attachable to the apparatus body;

a process unit that has an attachment portion to which the toner cartridge is detachably attached;

a restriction member provided on the toner cartridge, the restriction member being movable between (i) a restriction position at which relative movement between the toner cartridge attached to the attachment portion of the process unit and the process unit is restricted by an engagement of the restriction member and the process unit, and (ii) a non-restriction position, at which the relative movement between the toner cartridge and the process unit is not restricted; and a driving transmission unit for transmitting a driving force from the apparatus body to the toner cartridge by engaging with the apparatus body, wherein the restriction member has a driving force reception portion that is capable of receiving the driving force from the driving transmission unit by engaging with the driving transmission unit, and wherein the restriction member moves from the restriction position to the non-restriction position when the driving force reception portion receives the driving force from the driving transmission unit.

11. The image forming apparatus according to claim 10, wherein the toner cartridge is configured to be movable between (i) a first attachment position at which movement of the toner from the toner cartridge to the process unit is allowed in a state, in which an attachment operation of the toner cartridge to the attachment portion is completed, and (ii) a second attachment position at which the movement of the toner from the toner cartridge to the process unit is restricted in a state, in which the attachment operation of the toner cartridge to the attachment portion is not completed, and wherein the restriction member is configured to be placed at the restriction position when the toner cartridge is placed at the first attachment position.

12. The image forming apparatus according to claim 10, wherein the driving transmission unit is a gear, wherein the driving force reception portion is a rack that meshes with the gear, and wherein the restriction member receives the driving force from the apparatus body when the gear and the rack mesh with each other.

13. The image forming apparatus according to claim 10, wherein the toner cartridge has a positioning portion for positioning the restriction member by engaging with the restriction member, and an engagement position of the positioning portion with the restriction member is changed in accordance with a relative position of the restriction member with respect to the toner cartridge, and wherein the restriction member has an urging unit that applies to the positioning portion an urging force for restricting a change in an engagement position of the restriction member with the positioning portion after the restriction member moves from the restriction position to the non-restriction position.

14. The image forming apparatus according to claim 13, wherein the urging unit applies an urging force for urging the positioning portion to change the engagement position to the positioning portion when the restriction member moves from the restriction position to the non-restriction position.

15. The cartridge according to claim 6, wherein the rack has a tooth portion and a tooth-free portion, and wherein the tooth-free portion is configured to not contact the gear.

16. The image forming apparatus according to claim 12, wherein the rack has a tooth portion and a tooth-free portion, and wherein the tooth-free portion is configured to not contact the gear.

* * * * *